US012157864B2

(12) United States Patent
Braly

(10) Patent No.: US 12,157,864 B2
(45) Date of Patent: Dec. 3, 2024

(54) UNLEADED AVGAS COMPOSITION

(71) Applicant: GENERAL AVIATION MODIFICATIONS, INC., Ada, OK (US)

(72) Inventor: George W Braly, Ada, OK (US)

(73) Assignee: GENERAL AVIATION MODIFICATIONS, INC., Ada, OK (US)

( * ) Notice: Subject to any disclaimer, the term of this patent is extended or adjusted under 35 U.S.C. 154(b) by 0 days.

(21) Appl. No.: 18/333,169

(22) Filed: Jun. 12, 2023

(65) Prior Publication Data

US 2023/0323227 A1 Oct. 12, 2023

Related U.S. Application Data

(63) Continuation of application No. 17/409,585, filed on Aug. 23, 2021, now Pat. No. 11,674,100, which is a continuation of application No. 16/374,616, filed on Apr. 3, 2019, now Pat. No. 11,098,259, which is a continuation of application No. 13/841,560, filed on Mar. 15, 2013, now Pat. No. 10,260,016, which is a continuation-in-part of application No. 12/958,390, filed on Dec. 1, 2010, now Pat. No. 8,628,594.

(60) Provisional application No. 61/319,255, filed on Mar. 30, 2010, provisional application No. 61/316,158, filed on Mar. 22, 2010, provisional application No. 61/265,606, filed on Dec. 1, 2009.

(51) Int. Cl.

| | |
|---|---|
| ***C10L 1/223*** | (2006.01) |
| ***C10L 1/06*** | (2006.01) |
| ***C10L 1/14*** | (2006.01) |
| ***C10L 1/16*** | (2006.01) |
| ***C10L 10/10*** | (2006.01) |

(52) U.S. Cl.

CPC ..... *C10L 1/223* (2013.01); *C10L 1/06* (2013.01); *C10L 1/14* (2013.01); *C10L 10/10* (2013.01); *C10L 1/1608* (2013.01); *C10L 2270/023* (2013.01); *C10L 2270/04* (2013.01)

(58) Field of Classification Search

CPC .... C10L 1/223; C10L 1/06; C10L 1/14; C10L 10/10; C10L 1/1608; C10L 2270/023; C10L 2270/04

See application file for complete search history.

(56) References Cited

U.S. PATENT DOCUMENTS

| | | | |
|---|---|---|---|
| 1,495,501 | A | 5/1924 | Taber |
| 1,571,862 | A | 2/1926 | Midgley, Jr. |
| 1,592,953 | A | 7/1926 | Midgley, Jr. |
| 1,605,663 | A | 11/1926 | Kettering et al. |
| 1,606,431 | A | 11/1926 | Hamby |
| 1,713,589 | A | 5/1929 | Bereslavsky |
| 1,741,032 | A | 12/1929 | Minter |
| 1,844,362 | A | 2/1932 | Ihrig |
| 2,394,180 | A | 2/1946 | Imm |
| 2,398,197 | A | 4/1946 | Stanly |
| 2,409,156 | A | 10/1946 | Schulze et al. |
| 2,410,846 | A | 11/1946 | Walters |
| 2,413,262 | A | 12/1946 | Stirton |
| 2,476,315 | A | 7/1949 | Morrison |
| 2,560,602 | A | 7/1951 | Schulze |
| 2,637,635 | A | 5/1953 | McLaughlin |
| 2,917,561 | A | 12/1959 | Eby |
| 3,069,470 | A | 12/1962 | Fleck |
| 3,212,867 | A | 10/1965 | Ockerbloom |
| 3,267,165 | A | 8/1966 | Kimble |
| 4,010,358 | A | 3/1977 | Morris |
| 4,266,947 | A | 5/1981 | Hartle et al. |
| 4,294,587 | A | 10/1981 | Burns |
| 4,331,024 | A | 5/1982 | Childs et al. |
| 4,408,585 | A | 10/1983 | Stuckas |

(Continued)

FOREIGN PATENT DOCUMENTS

| | | |
|---|---|---|
| AU | 2006351908 B2 | 3/2011 |
| CA | 2672211 | 6/2008 |

(Continued)

OTHER PUBLICATIONS

Davidson, Hanson, Interpreting Shock Tube Ignition Data, Paper 03F-61, Mechanical Engineering Department, WSSCI Fall 2003 Meeting, Oct. 20-21, 2003, University of California (24 pages).

(Continued)

*Primary Examiner* — Jacob M Amick

*Assistant Examiner* — Charles J Brauch

(74) *Attorney, Agent, or Firm* — R. Reams Goodloe, Jr.

(57) ABSTRACT

Unleaded aviation gasoline. An aviation gasoline fuel blend includes an unleaded aviation gasoline base fuel, with an effective amount of selected alkyl benzenes to improve the functional engine performance to avoid harmful detonation sufficient to meet or exceed selected standards for detonation performance requirements in full scale aircraft piston spark ignition engines designed for use with Grade 100LL avgas. Suitable alkylated benzenes may include a mixture of xylene isomers. Aromatic amines, such as m-toluidine, may also be added to increase MON. Base fuels may be a high quality aviation alkylate, or may be a commercial iso-octane, or a mixture of high quality aviation alkylate enhanced by iso-octane, or by commercial iso-octane mixtures, and may include iso-pentane or butane or both iso-pentane and butane in sufficient quantity to provide appropriate vapor pressure for the final fuel blend.

41 Claims, No Drawings

(56) References Cited

U.S. PATENT DOCUMENTS

| | | | |
|---|---|---|---|
| 4,452,207 | A | 6/1984 | Moore, Jr. |
| 4,480,129 | A | 10/1984 | Priegnitz et al. |
| 4,695,292 | A | 9/1987 | Osborg |
| 4,897,087 | A | 1/1990 | Blain et al. |
| 5,087,781 | A | 2/1992 | Schutz et al. |
| 5,125,235 | A | 6/1992 | Yanagihara et al. |
| 5,284,984 | A | 2/1994 | Dessau et al. |
| H1305 | H | 5/1994 | Townsend et al. |
| 5,385,588 | A | 1/1995 | Brennan et al. |
| 5,470,358 | A | 11/1995 | Gaughan |
| 5,653,866 | A | 8/1997 | Jessup et al. |
| 5,851,241 | A | 12/1998 | Studzinski et al. |
| 5,891,202 | A | 4/1999 | Barratt et al. |
| 5,925,152 | A | 7/1999 | Barratt et al. |
| 5,941,222 | A | 8/1999 | Braly |
| 5,948,126 | A | 9/1999 | Barratt et al. |
| 5,962,775 | A | 10/1999 | Liiva et al. |
| 5,978,728 | A | 11/1999 | Fontana et al. |
| 6,187,064 | B1 | 2/2001 | Henderson |
| 6,238,446 | B1 | 5/2001 | Henderson |
| 6,258,134 | B1 | 7/2001 | Studzinski |
| 6,297,417 | B1 | 10/2001 | Samson et al. |
| 6,411,886 | B1 | 6/2002 | Morra et al. |
| 6,451,075 | B1 | 9/2002 | Schoppe et al. |
| 6,565,617 | B2 | 5/2003 | Kalghatgi |
| 6,767,372 | B2 | 7/2004 | Barnes et al. |
| 6,858,048 | B1 | 2/2005 | Jimeson et al. |
| 7,039,518 | B2 | 5/2006 | Ingram et al. |
| 7,416,568 | B2 | 8/2008 | Clark |
| 7,462,207 | B2 | 12/2008 | Clark |
| 7,553,404 | B2 | 6/2009 | Clark et al. |
| 7,740,668 | B2 | 6/2010 | Gaughan |
| 7,833,295 | B2 | 11/2010 | Clark |
| 7,862,629 | B2 | 1/2011 | Gaughan et al. |
| 7,897,034 | B2 | 3/2011 | Oliveira et al. |
| 8,049,048 | B2 | 11/2011 | Rusek et al. |
| 8,232,437 | B2 | 7/2012 | Clark et al. |
| 8,536,389 | B2 | 9/2013 | Clark |
| 8,628,594 | B1 | 1/2014 | Braly |
| 8,781,757 | B2 | 7/2014 | Farquharson |
| 9,120,991 | B2 | 9/2015 | Shea et al. |
| 10,260,016 | B2 | 4/2019 | Braly |
| 10,364,399 | B2 | 7/2019 | Braly |
| 10,377,959 | B2 | 8/2019 | Braly |
| 11,098,259 | B2 | 8/2021 | Braly |
| 2002/0005008 | A1 | 1/2002 | Studzinski et al. |
| 2002/0045785 | A1 | 4/2002 | Bazzani et al. |
| 2002/0055663 | A1 | 5/2002 | Barnes et al. |
| 2002/0166283 | A1 | 11/2002 | Kalghatgi |
| 2003/0000131 | A1 | 1/2003 | Henry et al. |
| 2003/0040650 | A1 | 2/2003 | Butler et al. |
| 2003/0183554 | A1 | 10/2003 | Bazzani et al. |
| 2004/0124122 | A1 | 7/2004 | Clark |
| 2005/0044778 | A1 | 3/2005 | Orr |
| 2005/0144834 | A1 | 7/2005 | Jimeson et al. |
| 2005/0229480 | A1 | 10/2005 | Gaughan et al. |
| 2006/0052650 | A1 | 3/2006 | Thebault et al. |
| 2006/0086040 | A1* | 4/2006 | De Oliveira ..... C10L 1/06 44/385 |
| 2006/0123696 | A1 | 6/2006 | Gaughan et al. |
| 2006/0225340 | A1 | 10/2006 | Gaughan et al. |
| 2006/0288635 | A1 | 12/2006 | Seyfried |
| 2007/0033859 | A1 | 2/2007 | Ketley et al. |
| 2007/0215519 | A1 | 9/2007 | Dierickx et al. |
| 2008/0134571 | A1 | 6/2008 | Landschof et al. |
| 2008/0168706 | A1 | 7/2008 | Rusek et al. |
| 2008/0172931 | A1 | 7/2008 | Bazzani et al. |
| 2008/0178519 | A1 | 7/2008 | Bazzani et al. |
| 2008/0244961 | A1 | 10/2008 | Rusek et al. |
| 2008/0244963 | A1 | 10/2008 | Demoment et al. |
| 2008/0289250 | A1 | 11/2008 | Bazzani et al. |
| 2008/0295388 | A1 | 12/2008 | Bazzani et al. |
| 2009/0013589 | A1 | 1/2009 | Aradi et al. |
| 2009/0229172 | A1 | 9/2009 | Brady et al. |
| 2009/0229173 | A1 | 9/2009 | Gosling |
| 2010/0018112 | A1 | 1/2010 | Russo et al. |
| 2010/0263262 | A1 | 10/2010 | Gaughan |
| 2012/0029251 | A1* | 2/2012 | Hemighaus ..... C10L 1/1608 585/14 |
| 2012/0080000 | A1 | 4/2012 | Landschof et al. |
| 2012/0279113 | A1 | 11/2012 | Landschof et al. |
| 2013/0111805 | A1 | 5/2013 | Mathur |
| 2014/0116367 | A1 | 5/2014 | Braly |
| 2014/0123548 | A1 | 5/2014 | Braly |
| 2014/0202069 | A1 | 7/2014 | Aradi |
| 2015/0113862 | A1 | 4/2015 | Shea et al. |
| 2019/0062658 | A1 | 2/2019 | Braly |
| 2019/0062659 | A1 | 2/2019 | Braly |

FOREIGN PATENT DOCUMENTS

| | | | | |
|---|---|---|---|---|
| EP | 1650289 | A1 | 4/2006 | |
| EP | 1611224 | B1 | 5/2010 | |
| EP | 2537913 | A1 | 12/2012 | |
| WO | WO 97/44413 | | 11/1997 | |
| WO | WO 98/22556 | | 5/1998 | |
| WO | WO 99/49003 | | 9/1999 | |
| WO | WO 02/22766 | A1 | 3/2002 | |
| WO | WO 2005/100513 | A2 | 10/2005 | |
| WO | WO 2006/026657 | A3 | 3/2006 | |
| WO | WO 2006/060364 | A3 | 8/2006 | |
| WO | WO 2007/074226 | A1 | 7/2007 | |
| WO | WO 2008/013922 | A1 | 1/2008 | |
| WO | WO 2008/073118 | A1 | 6/2008 | |
| WO | WO 2009/152495 | A2 | 12/2009 | |
| WO | WO 2009/152495 | A3 | 12/2009 | |
| WO | WO 2010/004395 | A1 | 1/2010 | |
| WO | WO-2010104581 | A2 * | 9/2010 | ..... C07C 2/66 |
| WO | WO 2011/035219 | A2 | 3/2011 | |
| WO | WO 2011/035219 | A3 | 3/2011 | |
| WO | WO2011/109575 | A2 | 9/2011 | |
| WO | WO2011/109575 | A3 | 9/2011 | |

OTHER PUBLICATIONS

Cummings, H.K., Detonation Rating of Aviation Fuels, 1st World Petroleum Congress, Jul. 18-24, 1933, London, UK, (13 pages).

Avgas Review-AFC 2007, Alisdair Clark; Clark Aviation Fuels Committee, AFC Mar. 21, 2007 (27 pages).

Executive Summary, CRC Research Results, Unleaded High Octane Aviation Gasoline, A Report to the CRC Unleaded AVGTAS Development Panel, Apr. 24, 2008 (9 pages).

Atwood, David, Full-Scale Engine Detonation, Tests of 47 Unleaded, High-Octane Blends, Sep. 2008, Final Report, DOT/FAA/AR-08/40 (287 pages).

Atwood, David, Full-Scale Engine Knock Tests of 30 Unleaded, High-Octane Blends, Sep. 2004, Final Report, DOT/FAA/AR-04-25 (314 pages).

Pye, Barton, Knock-Rating: Motor Gasoline and Aviation Gasoline, 1st World Petroleum Congress, Jul. 18-24, 1933, London, (6 pages).

Evans, Garner, The Knock-Ratings of Gasolines and Their Chemical Composition, 2nd World Petroleum Congress, Jun. 14-19, 1937, Paris, France, (7 pages).

Heron, Gillig, Supercharged Knock Testing, 2nd World Petroleum Congress, Jun. 14-19, 1937, Paris, France, (11 pages).

Hofman, Lapeyrouse, Sweeney, New Blending Agents for Aviation Gasoline of 100 Octane Number, 2nd World Petroleum Congress, Jun. 14-19, 1937, Paris, France, (8 pages).

Grebenshchikov, Influence of Gasoline Distillation Curve on Carburetor Icing, Journal Article, UDC 665.733.033.542.488, All-Union Scientific-Research Institute for Petroleum Processing (1981) (4 pages).

Persson, Hjelmco Oil AB, Presentation—Future fuels of aviation IAOPA WA, Toronto, 2006, Sweden (33 pages).

Hjelmberg, Hjelmco Oil AB, Presentation—Future fuels of aviation, Vasteras, Jan. 23, 2007 (33 pages).

Hjelmberg, Hjelmco Oil AB, Presentation—23 years of experience with Unleaded AVGAS in Sweden, (2004) (34 pages).

Hjelmco Oil, The Unleaded Aviation Gasoline With Improved Environmental Qualities, (AVGAS 91/96 UL), Edition: V. (Oct. 17, 1997) (22 pages).

(56) References Cited

OTHER PUBLICATIONS

Atwood, David, Full-Scale Engine Detonation and Power Performance Evaluation of Swift Enterprises 702 Fuel, Jan. 2009 Final Report, DOT/FAA/AR-08/53 (181 pages).
Research Results Unleaded High Octane Aviation Gasoline, Final Report, CRC Project No. AV-7-07, Jun. 2010 (298 pages).
Chevron, Aviation Fuels Technical Review, 2006 (96 pages).
Sakrison, Article, EAA Air Venture, Standards Sough For Unleaded Aviation Fuel, Aug. 1, 2008 (7 pages).
Department of the Navy, Advance Notice of Proposed Rulemaking on Lead Emissions from Piston-Engine Aircraft Using Leaded Aviation Gasoline, 75 FR 22440, Oct. 24, 2010, Docket No. EPA HQ OAR 2007 0294 (3 pages).
Bailey, Bunker, USSAF Europe WWII 100/150 GRADEFUEL, Sep. 1944 (10 pages).
Barnett, Report 1026, NACA Investigation of Fuel Performance In Piston-Type Engines (1951) (194 pages).
Sparrow, Report No. 232, Fuels for High-Compression Engines, NACA Report (1926) (20 pages).
Evaluation of Reciprocating Aircraft Engines with Unleaded Fuels, Dec. 1999, Final Report, DOT/FAA/AR-99/70 (82 pages).
Charnes, Cooper, Mellon, Econometrica, Journal of the Econometric Society, Blending Aviation Gasolines, A Study in Programming Interdependent Activities In An Integrated Oil Company, Accessed: 17:18 (Apr. 1952) (26 pages).
Johnston, Farrell, Laminar burning velocities and Markstein lengths of aromatics at elevated temperature and pressure, Proceedings of the Combustion Institute, 30 (2005) 217-224 (8 pages).
Executive Summary, CRC Research Results, Toward Development of an Unleaded High Octane Aviation Gasoline, A Report to the CRC Unleaded AVGAS Development Group, Apr. 1, 2003 (6 pages).
CRC Unleaded AVGAS Development Group Meeting, May 1, 2006, Alexandria, Virginia (8 pages).
Speight, The Chemistry and Technology of Petroleum, $4^{th}$ Edition, CRC Press, Copyright, 2007 (p. 745) (1 page).
Atwood, David, Full-Scale Engine Endurance Test of Swift Enterprises UL 102 Fuel, Jul. 2010, Final Report, DOT/FAA/AR-10/13 (70 pages).
Swift Enterprises, Presentation, Swift Sustainable Aviation Fuels, A High Octane Alternative to 100LL, EAA Airventure, Jul. 30, 2009 (28 pages).
Simpson, Martin J., The Douglas A/B-26 Invader, Fuel, (date unknown) (16 pages).
Millner, Paul, AVGAS 2020: The Future Fuel, Jun. 2006 (7 pages).
Atwood, David, High-Octane and Mid-Octane Detonation Performance of Leaded and Unleaded Fuels in Naturally Aspirated, Piston, Spark Ignition Aircraft Engines, Mar. 2007, Report, DOT/FAA/AR-TN07/5 (48 pages).
Desrosier, Presentation, Beyond 100LL, Next Steps In Addressing Leaded Aviation Gasoline, General Aviation Manufacturers Association (GAMA), GA AVGAS Coalition—2011 ACI NA Environmental Affairs Conference, Jun. 27, 2011 (28 pages).
Ziulkowski, Collective Knowledge on Aviation Gasolines, Purdeu e-Pubs, Jul. 10, 2011 (213 pages).
Rumizen, Aviation Gasoline, Status and Future Prospects, Presentation, 34th Annual FAA Forecast Conference, Apr. 1, 2009 (9 pages).
Orr, Fuel-ish Questions, Fuel-ish Answers, FAA Aviation News, Jul./Aug. 2009 (4 pages).
Waxman, Letter to Michael P. Huerta, FAA, Oct. 23, 2012 (2 pages).
Midgley, Shell, Presentation, AVGAS Octane, Is Motor Octane Number the Whole Story? AFC, Mar. 2010 (18 pages).
Winkle, Aviation Gasoline Manufacture, (1944), Production of Finished Aviation Gasolines, Chapter II cover pages (3 pages) and (pp. 182-183; 191-200).
Ells, AVGAS Alternatives, Feb. 2011, Flyingmag.com (3 pages).
FAA Aviation Safety, Special Airworthiness Information Bulletin, SAIB: NE-11-55, Sep. 14, 2011, Subject: Grade 100VLL Aviation Gasoline, (2 pages).
Kelly, Richard L., National Advisory Committee for Aeronautics, Wartime Report, Issued Nov. 1944 as Memorandum Report E4K17, The Low-Temperature Solubility of 24 Aromatic Amines in Aviation Gasoline, Aircraft Engine Research Laboratory, Cleveland, Ohio, NACA, Washington (E-164) (13 pages).
Kelly, Richard L., National Advisory Committee for Aeronautics, Wartime Report, Issued Nov. 1945 as Memorandum Report E5K09, The Low-Temperature Solubility of 42 Aromatic Amines in Aviation Gasoline, Aircraft Engine Research Laboratory, Cleveland, Ohio, NACA, Washington (E-167) (15 pages).
Brown, J.E. Mechanism of Aromatic Amine Antiknock Action. Industrial and Engineering Chemistry (Oct. 1955) vol. 47, No. 10, pp. 2141-2146 (6 pages).
Espacenet, European Patent Office. Bibliographic data: XP002539089
Brown, J.E. Mechanism of Aromatic Amine Antiknock Action. Industrial and Engineering Chemistry (Oct. 1955) vol. 47, No. 10, pp. 2141-2146. (1 page).
Jul. 25, 2016—Search Report and Written Opinion (European Patent Office) EP16154197 (6 pages).
Apr. 25, 2014 —PCT International Search Report with Written Opinion of International Searching Authority for PCT/US2014/011330 (Transmittal + 18 pages).
Sep. 24, 2015—PCT International Preliminary Report on Patentability, for PCT/US2014/011330 (Transmittal + 15 pages).
Options for Reducing Lead Emissions from Piston-Engine Aircraft. A Consensus Study Report of The National Academies of Sciences-Engineering-Medicine 2021, Transportation Research Board Special Report 336. The National Academies Press, Washington, DC. (Prepublication Copy—Uncorrected Proofs) . http://www.trb.org/Main/Blurbs/181701.aspx https://doi.org/10.17226/26050. (143 pages).
Freyermuth, George H. 1945-04-00—Super Fuel for Aircraft (5 pages).
Standard Specification for Aviation Gasolines. ASTM International, 2011 (Year: 2011)—ASTM Designation: D910-11 (8 pages).
https://www.chemicalbook.com/ProductChemicalPropertiesCB2681115 EN.htm (downloaded on Jan. 7, 2019) (2 pages).
Wikipedia—Toluidine (https://en.wikipedia.org/wiki/Toluidine) (2 pages).
G100UL Press Release—General Aviation Modifications, Inc.—First Ever High Octane Unleaded Avgas Approved by FAA. Oshkosh, Wis. / Jul. 27, 2021 (5 pages).

* cited by examiner

UNLEADED AVGAS COMPOSITION

CROSS REFERENCE TO RELATED APPLICATIONS

This application claims priority from, and is a continuation of prior U.S. patent application Ser. No. 17/409,585, filed on Aug. 23, 2021, (assigned U.S. Pat. No. 11,674,100 to be issued on Jun. 13, 2023), which application is a continuation of prior U.S. patent application Ser. No. 16/374,616, filed on Apr. 3, 2019 (now U.S. Pat. No. 11,098,259 B2 issued Aug. 24, 2021) and entitled High Octane Unleaded Aviation Gasoline. That application claimed priority from, and is a continuation of prior U.S. patent application Ser. No. 13/841,560 filed on Mar. 15, 2013, (now U.S. Pat. No. 10,260,016 B2 issued Apr. 16, 2019) and entitled High Octane Unleaded Aviation Gasoline. That application claimed priority from, and is a continuation-in-part of prior U.S. patent application Ser. No. 12/958,390, filed on Dec. 1, 2010 (now U.S. Pat. No. 8,628,594 B1 issued Jan. 14, 2014), and entitled High Octane Unleaded Aviation Fuel. That application claimed priority of prior U.S. Provisional Application Ser. No. 61/265,606 filed on Dec. 1, 2009, and of prior U.S. Provisional Application Ser. No. 61/316,158 filed on Mar. 22, 2010, and of prior U.S. Provisional Application Ser. No. 61/319,255 filed on Mar. 30, 2010. The disclosures of each of the above mentioned patent applications are incorporated herein in their entirety by this reference.

TECHNICAL FIELD

This development relates to fuels for spark ignition piston engines in general aviation aircraft, and more particularly, to unleaded aviation gasoline blends formulated without lead additives, in order to avoid lead emissions from the operation of such engines.

BACKGROUND

The existing fleet of general aviation spark ignition piston engines, as well as new engines currently being delivered, and engines which are overhauled for use as replacements on existing aircraft, typically operate using leaded fuels, as allowed in the United States under an exemption provided by the 1990 Federal Clean Air Act Amendments. As that Act banned the use of leaded fuels for over-the-road vehicles in the Unites States, general aviation aircraft engines have become an increasingly visible source of atmospheric lead emissions. Environmental regulations and threatened regulations throughout the world have thus spurred investigations into the development and evaluation of possible alternative aviation fuels.

Most of the general aviation spark ignition piston engines in use today have been certified in the United States by the Federal Aviation Administration (FAA) for use with leaded aviation gasoline blends that meet the American National Standard No. ASTM D910 entitled *Standard Specification for Aviation Gasolines*. Under that standard, for Grade 100 fuel, 1.12 grams of lead per liter are provided in the fuel blend. In the most commonly used fuel, Grade 100LL, known as a "low lead" fuel, 0.56 grams of lead per liter are provided in the fuel blend. Both of those blends provide a minimum "knock value" lean mixture octane number of 99.6 per the ASTM D-2700 Test Method. Also, both of those blends provide a minimum "knock value" rich mixture octane number of 130, per the ASTM D 909 Test Method.

Given the regulatory environment, both in the U.S. and internationally, that seeks to require the minimization or elimination of the use of lead in general aviation aircraft reciprocating piston engines, the US FAA has been instrumental in conducting tests on various heretofore proposed formulations for low lead or no lead aviation gasolines. Their reports are publicly available through the US National Technical Information Service (NTIS), Springfield, Virginia 22161. Such studies include the following reports:

(1) DOT/FAA/AR-04/25, entitled Full-Scale Engine Knock Tests of 30 Unleaded, High-Octane Blends, by David Atwood and Julian Canizales, issued by the Office of Aviation Research, Washington, D.C., in September 2004;

(2) DOT/FAA/AR-TN07/5, entitled High-Octane and Mid-Octane Detonation Performance of Leaded and Unleaded Fuels in Naturally Aspirated, Piston Spark Ignition Aircraft Engines, by David Atwood, issued by the U.S. Department of Transportation, Federal Aviation Administration, in March 2007;

(3) DOT/FAA/AR-08/40, entitled Full-Scale Engine Detonation Tests of 47 Unleaded High Octane Blends, by David Atwood, issued by the Office of Aviation Research, Washington, D.C., in September 2008; and (4) DOT/FAA/AR-08/53, entitled Full-Scale Detonation and Power Performance Evaluation of Swift Enterprises 702 Fuel, by David Atwood, issued by the Office of Aviation Research, Washington, D.C., in January 2009.

The September 2004 FAA report describes how over 200 blends of potential future aviation unleaded fuels were considered. Thirty of those blends, ranging in Motor Octane Number (MON) from 96.2 to 105.6 were sufficiently promising to be blended into batches and knock-tested (as determined by ASTM D-2700 standard) in a Lycoming IO-540-K aircraft engine at the FAA William J. Hughes Technical Center in Atlantic City, New Jersey. Components of such blends included ranges of some (or of all) of various ingredients, including super alkylate, toluene, ethyl tertiary butyl ether, meta-toluidine, ethanol, and methylcyclopentiadienyl manganese tricarbonyl (MMT), which were blended into a base fuel of either aviation alkylate or motor alkylate. Importantly, the FAA researcher reported that the performance of many of the tested blends deviated from that suggested by either their MON or by their performance number (PN).

The March 2007 FAA report compared detonation performance of mid and high octane leaded and unleaded fuels. The fuels were compared at the onset of light detonation. The fuels were tested in a naturally aspirated Lycoming IO-540-K engine and in a naturally aspirated Lycoming IO-320-B engine. For testing, the motor octane number (MON) of fuels was determined by ASTM International (ASTM) specification D2700. The supercharge rich rating was determined by the ASTM D-909 standard. In general, the testing showed that the Grade 100LL fuel (with values minimally meeting the MON and Supercharge Rating of ASTM D910) significantly outperformed the matrix of tested unleaded fuels of equivalent MON, including even those with much higher ASTM Standard D-909 supercharge rich ratings, particularly as seen when operated on full scale aircraft engines rather than the laboratory test engines used to establish the ASTM Standard D-2700 MON and the D-909 rich rating performance number (PN). The March 2007 report indicates that the supercharge rich ratings do not appear to have the same significance for the matrix of unleaded fuels that were tested as they do for leaded hydrocarbon fuels. Based on the blends tested, the report clearly suggests that development of a better detonation performance unleaded aviation fuel would be desirable.

The September 2008 FAA report was a continuation of the research described in the September 2004 report. Based on the results of the 30 potential future aviation unleaded fuel blends earlier tested, another matrix of 47 unleaded fuel blends was developed and detonation tested in a Lycoming IO-540-K aircraft engine at the FAA William J. Hughes Technical Center in Atlantic City, New Jersey. Components of such blends included varying ranges of "high octane components" such as aviation alkylate, super alkylate, toluene, ethyl tertiary butyl ether (ETBE), meta-toluidine, tert-butylbenzene. The blends contained iso-pentane for volatility control. Comprehensive blend formulations, by both volume fractions and mass fractions of those fuel blends were reported in Tables 2, 3, 4, and 5 of that report. The blends with a target range of 97.6 to 106.3 MON were tested against a baseline leaded reference fuel that met all specifications of ASTM D910 for Grade 100LL fuel with minimum MON and minimum performance number (PN) per ASTM D-909. The blends were also tested against a 100LL aircraft fuel purchased at the local airport. Here, the FAA researcher reported that none of the unleaded blends of equivalent or lower MON performed as well as the Grade 100LL fuel in the detonation tests, particularly as seen when operated on full scale engines rather than the laboratory test engines used to establish the ASTM D-2700 MON and the ASTM D-909 rich rating performance number. It was also demonstrated that increased fuel flow of the unleaded blends was required above the fuel flow required for 100LL in order to achieve equivalent detonation performance. In short, the tested blends provided less detonation protection than leaded formulations of equivalent MON, and appeared to potentially be less efficient. Importantly, the researcher again reported that using only motor octane number (MON) based on ASTM D-2700 (for knock rating, lean mixture) to predict full scale engine performance of unleaded fuels, is inadequate.

The January 2009 report provides results of tests on a high octane, bio-fuel (fermentation based) composition identified as Swift 702 fuel, from Swift Enterprises of Indiana. Swift 702 fuel was separately reported by Swift Enterprises, Inc., assignee of U.S. Patent Application Publication No. 2008/0244961 A1, published on Oct. 9, 2008, as being eighty three percent (83%) by weight of mesitylene (also known as, and hereinafter identified by the chemical name 1,3,5-trimethylbenzene), and seventeen percent (17%) by weight of iso-pentane. The FAA similarly reported that the Swift 702 fuel consisted of two pure chemical compounds. The Swift 702 fuel was reported by the FAA to have a motor octane number (MON) of 104.4, as determined by ASTM D-2700. The Swift 702 fuel was detonation tested in a Lycoming IO-540-K aircraft engine used in the tests noted in the two reports above. Also, the Swift 702 fuel was tested in a turbocharged non-intercooled Lycoming TIO-540-J2BD aircraft engine. These two engines were reported by the FAA as having been previously determined as having the highest octane requirements of engines in the active general aviation fleet. The Swift 702 fuel provided slightly better detonation performance than Grade 100LL fuel that was purchased from the local airport aviation gasoline fixed base operator. However, it did not meet the 50%, 90%, and end distillation points of the then current ASTM D910 specification. And, the energy content was noted as being only ninety three point six percent (93.6%) of Grade 100LL on a mass basis. Such a reduction in energy content, in conjunction with the higher fuel density, will reduce the available payload of the aircraft for a given trip of a given range. In some cases, such a reduction will be unacceptable to the operator, and may require expensive re-certification of the aircraft. Thus, it would be desirable that any replacement aviation fuel more closely meet the presently existing ASTM minimum specifications with respect to energy content per unit mass of fuel, in order to minimize any potential loss of range or payload for an aircraft using such fuels. And, it would be desirable to provide a replacement aviation fuel that minimizes the quantity of 1,3,5-tri-methylbenzene that must be produced to provide sufficient unleaded fuel to the aviation marketplace, since such compound is not presently produced in commodity quantities for fuel blending, and may be more expensive, even in large scale production, than other possible unleaded aviation gasoline components.

In other work, U.S. Pat. No. 5,470,358, entitled Unleaded Aviation Gasoline, was issued Nov. 28, 1995 to Gaughan, and assigned to Exxon Research & Engineering Co.; the disclosure of that patent is incorporated herein in its entirety by this reference. The Gaughan patent discloses an unleaded aviation fuel that combines (a) an aviation gasoline base fuel having a motor octane number (MON) of 90-93, with (b) an amount of at least one aromatic amine as that is effective to boost the motor octane number (MON) of the base fuel to at least about 98. However, many high performance aircraft engines require better performing fuels, i.e. fuels that at least have the ability to run at all significant operating conditions in a manner substantially equivalent to that presently provided by at least a fuel that meets the minimum ASTM D910 specification for Grade 100LL, if not more. An unleaded fuel blend that only provides performance equivalent to that of a 98 MON avgas on a full scale engine will likely fail at times to meet necessary engine performance requirements. Thus, it would be desirable that a fuel provide performance that meets or exceeds the minimum ASTM D910 specifications for Grade 100LL fuel. It would be even more desirable to provide a fuel that meets or exceeds in full scale aircraft engine testing the performance of an FBO Grade 100LL fuel having a selected MON. As discussed elsewhere herein, it is common for FBO Grade 100LL fuels to have a selected MON well in excess of the minimum ASTM D910 specifications for Grade 100LL fuel.

U.S. Pat. No. 6,258,134 B1, entitled High Octane Unleaded Aviation Gasolines, issued Jul. 10, 2001 to Studzinski et al., and assigned to Texaco, Inc., discloses an unleaded aviation fuel of at least 94 motor octane number (MON). The disclosure of U.S. Pat. No. 6,258,134 B1 is incorporated herein in its entirety by this reference. In an embodiment, that disclosure provides an unleaded aviation fuel having a motor octane number (MON) of at least 94, made up of the combination of (1) an unleaded alkylate base fuel having a boiling point range that is substantially wider than the range of boiling points in aviation base fuel, and having a motor octane number (MON) of at least 91, (2) an alkyl tertiary butyl ether, and (3) an aromatic amine. Yet, high performance aircraft engines require better performing fuels. Further, it would be desirable to provide an unleaded aviation fuel that avoids the use of oxygenated components, such as alcohols or ethers, especially since use of the latter class of compounds has been eliminated by governmental regulation in many countries.

In Europe, Hjelmco Oil AB of Sweden has been selling unleaded avgas of various blends, including a 91/96 motor octane number (MON) unleaded blend that may be used in 91/96 and in 80/97 octane engines. See http://www.hjelmco-.com. The 91/96 UL MON blend was first produced in Finland and introduced in 1991, and is now produced in Sweden. Hjelmco now reports on the above noted website that it is considering a Bio-alkylate derived avgas in a possible replacement for existing Grade 100LL avgas. However, in so far as I am aware, they do not yet offer a product that is capable of providing adequate detonation performance in 100/130 octane aviation engines, in spite of their many years of experience in blending and providing unleaded aviation fuels.

Finally, U.S. Pat. No. 6,767,372 B2, entitled Aviation Gasoline Containing Reduced Amounts of Tetraethyl Lead, issued Jul. 27, 2004 to Barnes et al, and assigned to Chevron U.S.A. Inc., discloses an unleaded aviation fuel of at least 94 motor octane number (MON). The disclosure of U.S. Pat. No. 6,767,372 B2 is incorporated herein in its entirety by this reference. In an embodiment, that disclosure provides an unleaded aviation fuel having, measured by volume, (a) about twenty percent (20%) to about eighty percent (80%) of iso-octane, (b) about five percent (5%) to about eighteen percent (18%) of toluene, (c) about one percent (1%) to about twenty percent (20%) of $C_4$ to $C_5$ paraffins, (d) greater than zero (0) to about one (1) ml of tetraethyl lead per gallon of the aviation gasoline composition, and (e) the balance of the composition being light alkylate produced in an alkylation unit using hydrogen fluoride or $H_2SO_4$ as a catalyst. In an embodiment, that aviation gasoline is described as being substantially free of ether compounds, such as methyl tertiary butyl ether (MTBE) or ethyl tertiary butyl ether (ETBE) or the like. However, the Barnes et al patent does not describe whether or not there is any possibility within the otherwise described ingredients to completely eliminate the use of tetraethyl lead. And, although it teaches reduced lead compositions in an aviation fuel, it does not provide specific suggestions as to possible formulations using the components described therein that might tend to further minimize or eliminate the use of tetraethyl lead in order to meet or exceed performance standards for presently existing for Grade 100LL aviation fuel.

Thus, in spite of the extensive testing and evaluation by the FAA and by others of various candidate unleaded aviation fuel blends, and other work as noted in the above described patent literature, there still remains an as yet unmet need for an unleaded aviation gasoline blend that can be readily used in the existing general aviation piston engine aircraft fleet as a "drop in substitute". Such an unleaded aviation gasoline, particularly a fuel blend that is essentially transparent in functionality to the aircraft engine during various flight operations as compared with existing Grade 100LL fuels, and which could be mixed in the aircraft fuel tank in a random manner with existing Grade 100LL fuel formulations, would assist in the reduction or phase out of existing lead containing aviation gasolines. That is because rather than requiring a simultaneous wholesale and widespread switch in unleaded aviation gasoline availability, if such a new unleaded aviation gasoline becomes available, then existing fuel systems could accommodate and provide a new unleaded aviation gasoline as it becomes locally available from suppliers. And, aircraft crews would not need to be concerned with whether previously existing 100LL fuel or a new unleaded aviation gasoline blend were available at any particular airfield. Further, it would be advantageous if a new unleaded aviation gasoline were available that could be utilized with little or no mechanical alterations or replacements of existing aircraft engines or aircraft system adjustments, and which could be used with little or no additional certification or other regulatory changes from the aircraft owner or operator standpoint. And, such an unleaded aviation gasoline would be of benefit to aircraft engine manufacturers and to aircraft manufacturing companies, as a fuel having such characteristics should enable them to avoid the need for extensive redesigns of equipment, testing, and recertification that might be required if an unleaded aviation fuel with less desirable performance characteristics were selected for widespread use. It would also be especially advantageous if in an embodiment, such a new unleaded aviation gasoline, rather than having substantially less than existing energy content for use by the aircraft, would provide as much or more energy per unit volume of fuel tank capacity, i.e. British Thermal Units (BTU's) per gallon, as existing Grade 100LL fuels. In such a manner, it would be particularly advantageous if a new unleaded aviation gasoline could be used to take full advantage of the existing mechanical design components with respect to mass flow of air into the engine, and materials of construction utilized in the fuel system, and be capable of operating without knock or detonation at rich and lean air fuel ratio conditions, with existing compression ratios, with full rated power output, in a stable and highly efficient manner in all flight operating conditions, including high power cruise conditions with lean air-fuel mixtures.

Moreover, it would be advantageous to provide a new unleaded aviation gasoline that may be produced and distributed as a substitute for, and in the same manner as, existing petroleum feedstock aircraft fuels, using existing refinery production systems and fuel distribution systems. It would be even more useful if such a replacement aircraft fuel were provided that meets the ASTM D910 specification for detonation margins and further, either meets the remaining ASTM D910 Table 1 requirements or which only exhibits deviations from those requirements of a nature and to an extent that are not operationally significant to the pilot and the aircraft while completely eliminating the use of lead additives.

It would also be advantageous to accomplish such goals while providing an unleaded aviation gasoline suitable for "drop-in" substitution, fully fungible with existing Grade 100LL aviation gasoline, in order to minimize the extent, complexity, and cost of any recertification efforts of the high performance, high-octane fuel powered engines found in existing general aviation aircraft. As used herein, the term "drop-in" substitution is directed to a fuel that meets aircraft engine performance requirements from an operational standpoint, and can be used transparently, from the operational standpoint (including fueling of and holding in the fuel tank, holding and processing in the fuel systems of an aircraft during storage and during operation, and consumed by combustion during operation of the aircraft engine, and producing environmentally acceptable products of combustion). As such, a "drop-in" fuel as described herein may or may not meet all of the current ASTM D910 specifications requirements (or a future/then current later generation similar fuel specification), except for the absence of lead. Unofficially, in some aviation fuels industry circles, such usage—i.e. meeting performance requirements but not strictly meeting ASTM or other specifications—might otherwise be known as having the capability of a "quasi-drop-in" fuel—i.e. a fuel that meets performance requirements but does not strictly meet all of the applicable ASTM D910 specifications. In any event, it would be very helpful to the general aviation piston engine user community to have available a fuel which could be placed in the aircraft tanks and used without regard to changes in mechanical components or aircraft performance, and which will therefore minimize or eliminate regulatory paperwork. It would be even more helpful, and quite advantageous, for a new unleaded aviation gasoline to be made available that meets such objectives, and that also can be used without alterations to the aircraft or engines and without substantive changes in existing operational manuals, other than to add to the limitations section of such operational manuals the approval of the use of a new grade or description of fuel which is approved and related instructions to the pilot for how the new unleaded aviation gasoline is to be used.

SUMMARY

Exemplary unleaded high octane unleaded aviation gasoline blends are described herein, as well as methods for preparation of the same, and methods for operation of aircraft using the same. In an embodiment, a high octane unleaded aviation gasoline fuel blend provides a drop-in substitution that enables use of full rated power output from existing engines, in a manner equivalent to the power output obtained when using existing FBO Grade 100LL avgas blends. Further, in an embodiment, such a new unleaded aviation gasoline fuel blend enables aircraft engine operation in a fuel efficient and economical manner, especially as compared to potential losses that might arise in various heretofore proposed Grade 100LL aviation fuel substitutes.

In an embodiment, a novel unleaded aviation gasoline blend is provided for use in piston engines. In an embodiment, an unleaded fuel blend includes (a) at least one unleaded aviation gasoline base fuel having a selected motor octane number (MON), and (b) an amount of a selected alkyl benzenes effective to increase the detonation performance of the unleaded aviation gasoline blend to the equivalent, or better than, the detonation performance in a full scale aircraft engine of Grade 100LL avgas which minimally meets the motor octane rating requirements set forth in ASTM Standard D910. In an embodiment, selected alkyl benzenes may include one or more di-alkyl or tri-alkyl benzene compounds. In an embodiment, such compounds having methyl groups in the meta-ring position. In an embodiment, selected alkyl benzenes may include dimethylbenzenes. In an embodiment, such alkyl benzenes may include trimethylbenzenes. In an embodiment, selected dimethylbenzenes may include 1,3-dimethylbenzene (also known as meta-xylene or m-xylene). In an embodiment, the amount of 1,3-dimethylbenzene may be at least about forty percent (40%) by weight of an unleaded aviation gasoline blend. Another embodiment for a useful unleaded aviation gasoline blend includes (a) about fifty five percent (55%) to about forty five percent (45%) by weight of an unleaded aviation gasoline base fuel, and (b) about forty five percent (45%) by weight to about fifty five percent (55%) by weight of 1,3-dimethylbenzene. In an embodiment, the amount of 1,3-dimethylbenzene may be about forty five percent (45%) by weight, or more, of an unleaded aviation gasoline blend. In an embodiment, the amount of 1,3-dimethylbenzene may be about fifty percent (50%) by weight, or more, of an unleaded aviation gasoline blend. In yet other embodiments, the amount of 1,3-dimethylbenzene may be about fifty five percent (55%) by weight, or more, of an unleaded aviation gasoline blend.

In an embodiment, a suitable alkyl benzene may be trimethylbenzene. In an embodiment, a useful trimethylbenzene may be 1,3,5-trimethylbenzene (also known as mesitylene). In an embodiment, the amount of 1,3,5-trimethylbenzene may be at least about twenty percent (20%) by weight of an unleaded aviation gasoline blend. In an embodiment the amount of 1,3,5-trimethylbenzene may be thirty percent (30%), or more, by weight of an unleaded fuel blend. In an embodiment, the amount of 1,3,5-trimethylbenzene may be up to about fifty percent (50%) by weight of an unleaded aviation gasoline blend.

In an embodiment, the selected alkyl benzene(s) such as just described in the preceding paragraph are provided in an amount effective to increase the detonation performance of the unleaded aviation gasoline blend to the equivalent, or better than, the detonation performance in a full scale aircraft engine of a selected FBO Grade 100LL avgas having a selected MON (Full Scale Engine Equivalent MON, or "FSEEMON" as further discussed herein below).

Throughout this disclosure, reference may be made to the "Full Scale Engine Equivalent Motor Octane Number"—which may be abbreviated herein by use of the acronym "FSEEMON". After extensive testing of various candidate aviation fuels in a full scale aircraft engine, for example as noted with respect to various tests described herein below, I have repeatedly observed that certain candidate unleaded aircraft fuel blends, and particularly those blends which include one or more alklylated benzenes that include methyl groups in meta-ring positions, perform better in a full scale aircraft engine than might be anticipated given the motor octane number ("MON") that such fuels are determined to have by laboratory testing at moderate to heavy knock intensity levels. Thus, I have developed the term "FSEEMON"—Full Scale Engine Equivalent Motor Octane Number—to describe the comparative detonation performance of a selected unleaded aviation gasoline blend when the selected novel unleaded aviation gasoline blend is tested in a full scale aircraft engine at moderate to heavy knock intensity levels, as against performance demonstrated under the same conditions (preferably in the same or identical engines) by a selected FBO Grade 100LL fuel of selected MON as determined by laboratory testing using standard ASTM test procedures at engine operating conditions sufficiently severe to result in observed detonation intensity values of forty (40) BAR, or more, when using the ASTM D6424 algorithm to quantify detonation intensity for multiple sequential combustion events. Thus, the FSEEMON of a selected novel unleaded aviation gasoline blend may or may not be equivalent to the MON as determined by laboratory testing using standard ASTM test procedures. Generally, in testing the novel unleaded aviation gasoline blends described herein, containing as a significant component one or more alkylated benzenes that include methyl groups in meta-ring positions, I have found that the FSEEMON is equal to or greater than would be expected based on the MON of such novel unleaded aviation blend as determined in laboratory testing using standard ASTM test procedures. Not infrequently, the FSEEMON of such an unleaded aviation gasoline fuel blend, when tested on a high performance aircraft engine, is at least equal to performance of a leaded aviation gasoline of the same ASTM MON, and in some cases, it is greater than the standard ASTM test MON by one (1) or more points of octane.

Additionally, in order to increase motor octane number (MON) of a final unleaded aviation gasoline blend in a cost effective manner, and to simplify the manufacturing of novel unleaded aviation gasoline blends as described herein, in various embodiments, one or more aromatic amines may be utilized by an avgas manufacturer in a method of manufacturing unleaded avgas to increase the MON, in order to provide detonation performance in a full scale engine equivalent to that, or better, of an FBO Grade 100LL avgas of a selected MON. In various embodiments, such one or more aromatic amines may be utilized by an avgas manufacturer in a method of manufacturing avgas to increase the MON, in order to provide a "knock value", as Motor Octane Number (MON) of at least 99.6, as measured by the ASTM D2700 Test Method. In an embodiment, the amount of aromatic amines provided may be somewhere in the range from more than zero up to a maximum of about four point five percent (4.5%) by weight in the final aviation unleaded fuel blend. In an embodiment, the amount of aromatic amines provided may be somewhere in the range from more than zero up to a maximum of about six percent (6.0%) by weight in the final aviation unleaded fuel blend. In an embodiment, a single aromatic amine may be selected for use in a high octane unleaded fuel blend. In an embodiment, a suitable aromatic amine may be meta-toluidine (also known as m-toluidine). In an embodiment, a selected aromatic amine used in a high octane unleaded fuel blend may be any one of the six xylidine isomers, or a mix of such isomers, or a mix of such isomers and other aromatic amines. In an embodiment, xylidines having methyl groups only at the meta or para positions may be utilized.

Various embodiments of an unleaded aviation gasoline blend may be formulated using at least one base fuel, and in various cases, one or more selected unleaded aviation gasoline base fuels having a selected motor octane number (MON) of at least 90, or in the range of 90 to 93, or up to about 94, or of about 95, or about 96, or more. Such base fuels may include high grade aviation alkylates, or commercial iso-octane mixtures.

In an embodiment, a suitable unleaded aviation gasoline base fuel may include, by weight, (a) about twenty percent (20%) to about ninety percent (90%) of commercial grade iso-octane, and (b) about one percent (1%) to about twenty percent (20%) of $C_4$ to $C_5$ paraffins. In an embodiment, suitable $C_5$ paraffins may include iso-pentane. An effective amount of iso-pentane may be included in an unleaded aviation gasoline unleaded base fuel blend (or added thereto) as appropriate to achieve a desired distillation curve and/or vapor pressure objectives. Similarly, an effective amount of butane or iso-butane may be included in an unleaded aviation gasoline unleaded base fuel blend (or added thereto) as appropriate to achieve a desired distillation curve objective and/or vapor pressure objective. In an embodiment, a base fuel may additionally include light alkylates. As used herein, the term "light alkylates" includes mixtures of $C_6$ to $C_9$ iso-paraffins. Such compounds may include trimethylpentane isomers, and other iso-paraffins. Generally, light alkylates may be distinguished from iso-octane by their lower octane number(s). In an embodiment, from about zero (0) to about twenty percent (20%) by weight of one or more aliphatic aromatic hydrocarbons may be included in the unleaded aviation gasoline base fuel.

In an embodiment, a suitable aviation unleaded base fuel may be provided by a mixture of (a) iso-octane (at about seventy percent (70%) or more by weight) and (b) iso-pentane (at about twenty percent (20%) or less by weight). In an embodiment, a suitable commercial grade iso-octane may be provided having a MON of at least 97, per the ASTM D910 test procedure. In an embodiment, a suitable commercial grade iso-octane may be provided having a MON of at least 98, per the ASTM D910 test procedure. In an embodiment, a suitable commercial grade iso-octane may be provided having a MON of at least 99, per the ASTM D910 test procedure. In an embodiment, a suitable iso-octane may be provided using commercial grade 2,2,4 tri-methyl pentane.

Various unleaded aviation base fuels are described explicitly herein below, or are incorporated herein by reference, and one or more of such base fuels may be used in preparation of a useful unleaded aviation gasoline blend according to the teachings herein.

In an embodiment, the aviation base fuel may include, or have added thereto, and effective amount of butane, and or iso-pentane, to provide desirable distillation curve objectives, compliance with vapor pressure specifications, and aircraft engine starting properties.

In various embodiments, the unleaded fuel blend may include from about ten percent (10%) to about fifteen percent (15%), by weight, of one or more additional octane increasing aliphatic aromatic hydrocarbon compound(s). Suitable additional aliphatic aromatic hydrocarbon compounds may include toluene, ethyl benzene, meta-xylene, ortho-xylene, para-xylene, 1,3,5-trimethylbenzene, or other compounds in that class of hydrocarbons. In an embodiment, including those aliphatic aromatic hydrocarbons with octane enhancing properties may be particularly useful, and in particular, those having methyl groups in the meta-ring position. In an embodiment, one or more selected additional aromatic hydrocarbons may be chosen, and amounts or percentages utilized, may be selected, as useful to provide a selected distillation profile for a final unleaded aviation gasoline blend, as will be understood by those of skill in the art and to whom this specification is directed. In such embodiments, a blend of constituent compounds may be balanced to meet both distillation profile objectives and the performance requirements for a final unleaded aviation gasoline blend.

In an embodiment, one or more combinations of the selected additional aromatic hydrocarbons may be chosen, and amounts or percentages utilized, may be selected, as useful to provide a selected distillation profile for a final unleaded aviation gasoline blend, as will be understood by those of skill in the art and to whom this specification is directed. For example, 1,2-dimethylbenzene or ethylbenzene may be tolerated in such novel fuel blends, as might be necessary or desirable to utilize cost effective raw materials, such as commercially available xylol blends. And, while 1,4-dimethylbenzene may be likewise tolerated in moderate amounts, the total quantity of same, much as for various other products (and with respect to which those of skill in the art will recognize) should be limited as necessary to assure adequate cold weather and/or freezing point characteristics of the high octane unleaded aviation gasoline blend. In such embodiments, it may be advantageous to provide a blend of constituent compounds that is balanced so as to meet both distillation profile objectives (e.g, a distillation distribution curve that meets, or may fairly approximate, the profile set forth under ASTM Standard D86) and the required performance properties for a useful high octane unleaded aviation gasoline fuel blend.

DETAILED DESCRIPTION

Exemplary piston engine unleaded aviation gasoline blends are set forth herein. Methods for the preparation of such novel unleaded aviation gasoline blends, and methods for use of such novel unleaded aviation gasoline blend(s) as efficient direct "drop-in-substitutions"—or at least for "functional drop-in substitutions" which provide equivalent performance in spite of some deviations from standard ASTM specifications for aviation gasolines—for existing aviation fuels (such as the leaded aviation Grade 100LL fuel) are set forth herein. Generally, as the term is used herein, "unleaded aviation gasoline" refers to gasoline possessing the specific properties suitable for fueling aircraft powered by reciprocating spark ignition engines, where lead is not intentionally added at the point of manufacture or first shipment.

As a result of testing of a novel unleaded aviation gasoline blend in a full scale aircraft engine test stand, as well as in a turbocharged aircraft in flight, I have now discovered that it is possible to provide, in an embodiment, an unleaded aviation gasoline blend by mixing (1) an unleaded aviation gasoline base fuel (high grade aviation alkylate or commercial iso-octane or mixtures thereof), with (2) an amount of an alkylated benzene, and particularly methylbenzenes having at least some methyl groups in the meta-ring position (for example, 1,3-dimethybenzene, and/or 1,3,5-trimethylbenzene) that is effective to increase the detonation performance of the unleaded aviation gasoline blend when operated on a full scale aircraft engine to the equivalent, or better than, the full scale engine detonation performance of a Grade 100LL avgas which minimally meets the octane rating requirements set forth in ASTM Standard D910. In other words, in an embodiment, the FSEEMON of the novel unleaded aviation gasoline blend will be equivalent to the full scale engine performance of a Grade 100LL avgas which meets the minimum MON rating requirements set forth in ASTM D910. Further, such testing has determined that an unleaded aviation gasoline blend may be formulated that provides detonation performance when operated on full scale aircraft engines to approximately the equivalent of, or better than, the full scale engine detonation performance of a FBO Grade 100LL avgas having a selected MON. Such benefits are especially noticeable when the testing proceeds using standard ASTM test procedures at detonation performance conditions of forty (40) BAR, or more, when using the ASTM D6424 algorithm to quantify detonation intensity levels.

Thus, by testing the novel unleaded aviation gasoline blends described herein at load in an actual aircraft engine in a fully instrumented test stand, it was observed that, at least to some extent, the detonation performance on the full scale aircraft engine of certain novel unleaded aviation gasoline blends exceeds the detonation performance which would be expected for such blends based on MON test results, or other existing test standards (e.g. the ASTM D 2700 motor octane test required under ASTM Standard D910). Again, such beneficial performance is especially noticeable when the testing proceeds using standard ASTM test procedures at detonation performance conditions of forty (40) BAR, or more, when using the ASTM D6424 algorithm to quantify detonation intensity levels.

Such beneficial synergistic effect seems to especially manifest itself as demonstrated in full scale aircraft engine detonation performance testing in the case of novel unleaded aviation fuel blends which include alkylated benzenes having methyl groups in a meta-ring position. For example, using a mixture of 1,3-dimethylbenzene (meta-xylene) and 1,4 dimethylbenzene (para-xylene, in amounts when added together amounts to slightly less than about half, by weight (e.g. up to a maximum of forty five percent (45%) by weight) of the total unleaded aviation gasoline blend in connection with other constituents as described herein may provide the necessary performance properties. However, various other alkylated benzenes, such as ethyl benzene and ortho-xylene, may compose a portion of such mixture in order to facilitate commercially economical production and meet overall fuel blend performance objectives.

Further, testing has determined that an unleaded aviation gasoline blend may be provided by blending (1) an unleaded aviation gasoline base fuel, and (2) an effective amount of 1,3-dimethylbenzene, to provide an unleaded aviation gasoline blend that, when operated on full scale aircraft engines provides the detonation performance at least equal to the rich mixture detonation performance of typical FBO Grade 100LL. Such typical Grade 100LL fuels as purchased from the local airport aviation gasoline fixed base operator are referred to herein "FBO Grade 100LL". The detonation performance of FBO Grade 100LL is even better than the detonation performance which would be expected from a Grade 100LL avgas which only minimally meets octane rating requirements set forth in ASTM Standard D910.

Example Blend A

A turbocharged high compression aircraft test engine was operated to compare (a) an airport available FBO Grade 100LL blend, with (b) a novel unleaded aviation gasoline having, by weight percent, (a) about fifty four percent (54%) of an unleaded aviation gasoline base fuel of about 95-96 MON and having primary components (by weight) of about seventy nine percent (79%) iso-octane and about fifteen percent (15%) iso-pentane, (b) about forty five percent (45%) of 1,3-dimethylbenzene, and (c) about one percent (1%) by weight of butane. A six (6) cylinder, five hundred fifty (550) cubic inch displacement spark ignition reciprocating aircraft piston engine was operated at rich mixture and lean mixture test conditions. Engine operation on the just described unleaded aviation gasoline blend resulted in knock index averages observed in the various cylinders which were demonstrably better than knock index averages during engine operation using a reference test fuel having the characteristics of a leaded aviation gasoline similar to Grade 100LL fuel, but with a measured MON of about 100.5 to 101. Operating results were approximately equivalent to those encountered when operating under lean conditions with 100.5 MON to 101 MON Grade leaded fuels. Test operational results with rich mixtures were nearly as good as those provided by locally purchased FBO Grade 100LL avgas. Thus, it was demonstrated that 1,3-dimethylbenzene may be used, in combination with an unleaded aviation base fuel, as well as a minor amount of other selected ingredients, to provide an unleaded aviation gasoline blend which will enable existing aircraft piston engines to operate free from harmful detonation.

Example Blend B

A turbocharged high compression aircraft test engine was operated to compare (a) an airport available FBO Grade 100LL blend, with (b) a novel unleaded aviation gasoline blend having, by weight percent, (a) about forty five percent (45%) by weight of an aviation unleaded aviation gasoline base fuel of about 95-96 MON, and (b) about fifty five percent (55%) by weight of 1,3-dimethylbenzene. The unleaded aviation gasoline base fuel of about 95-96 MON included as primary components about seventy nine percent (79%) iso-octane and about fifteen percent (15%) iso-pentane, by weight. It will be understood by those of skill in the art that in addition to the aforementioned primary components, refined products such as an unleaded aviation base fuel may typically include an assortment of other hydrocarbons in relatively minor concentrations, as resulting from conventional manufacturing operations.

A six (6) cylinder, five hundred fifty (550) cubic inch displacement spark ignition reciprocating aircraft piston engine was operated in a test stand to compare the novel unleaded aviation gasoline blend with the locally purchased FBO Grade 100LL avgas. The knock index averages observed in the various cylinders were very close to those observed when operating using a locally purchased FBO Grade 100LL avgas (which was laboratory tested and determined to have a motor octane number (MON) of approximately 102.5). It is presently believed, based on experience with comparable tests in the aforementioned engine test stand, that the demonstrated performance exhibited by the novel unleaded aviation gasoline blend in the full scale test engine is at the level of a FSEEMON of an FBO Grade 100LL having a laboratory test rating of 102 MON, when the testing was conducted using standard ASTM test procedures at detonation performance conditions of forty (40) BAR, or more, when using the ASTM D6424 algorithm.

Example Blend C

A turbocharged high compression aircraft test engine was operated to compare (a) an airport available FBO Grade 100LL blend with (b) a novel unleaded aviation gasoline blend having, by weight percent, about sixty seven percent (67%) of an unleaded aviation gasoline base fuel and about thirty three percent (33%) of 1,3,5-trimethylbenzene. A six (6) cylinder, five hundred fifty (550) cubic inch displacement spark ignition reciprocating aircraft piston engine was operated at about three hundred fifty three (353) brake horsepower at about 0.478 BSFC (brake specific fuel consumption, pounds mass of fuel per hour per horsepower). Some of the operating conditions during testing are set forth below in Table 1. Unexpectedly, the knock index averages observed in the various cylinders were almost identical as between the locally purchased FBO Grade 100LL avgas and the novel unleaded aviation gasoline blend, which has been designated in the chart below as G100UL, when the testing proceeded using standard ASTM test procedures at detonation performance conditions of forty (40) BAR, or more, when using the ASTM D6424 algorithm. Each of the six cylinders exhibited very similar Detonation Index Average Numbers, when switched between the two fuels noted above.

TABLE 1

| Grade Fuel | MAP | RPM | Displacement | Fuel Flow (lb/hr) | Comp. Ratio | IAT | Peak Internal Cylinder Pressure | BSFC (lbs/hr/hp) | BHP |
|---|---|---|---|---|---|---|---|---|---|
| FBO 100LL | 33.2 | 2664 | 550 c.i. | 168.6 | 8.5:1 | 156 | ~1080 to 1150 PSI | 0.478 | ~353 |
| G100UL | 33.3 | 2660 | 550 c.i. | 167.9 | 8.5:1 | 159 | ~1060 To 1160 PSI | 0.473 | ~355 |

The data in Table I is from a popular aircraft engine set up so that it was producing power at levels in excess of its certified power levels. In this instance the engine was set up with a fuel flow best characterized as near a "best power" mixture setting. There was full six cylinder detonation detection instrumentation in use. The engine was observed to occasionally experience light detonation on both fuels on some of the six cylinders. Continued observation of the operation of the engine on each fuel revealed that the level of detonation was consistently measured to be approximately the same intermittent light knock level, regardless of which of the two fuels was being consumed.

In so far as I am aware, it has not been recognized and applied, prior to the developments described herein, that 1,3,5-trimethylbenzene may be used to provide a significant portion (e.g. twenty five percent (25%) or more by weight, up to a maximum of about forty five percent (45%) by weight of an unleaded aviation gasoline blend) in combination with an aviation gasoline base fuel composition, to provide a novel unleaded aviation gasoline blend that meets minimum fuel specification requirements of the current aircraft piston engines in order to operate free from harmful detonation.

Example Blend D

A turbocharged high compression aircraft test engine was operated to compare (a) a selected airport available FBO Grade 100LL blend having a selected MON, with (b) a novel unleaded aviation gasoline blend having, by weight percent, about thirty six point six five percent (36.65%) of iso-octane (2,2,4-trimethylpentane), about thirty seven point four percent (37.4%) of 1,3-dimethylbenzene, about four percent (4%) of 1,4-dimethylbenzene, about four point three percent (4.3%) of 1,2-dimethylbenzene, about two point six percent (2.6%) ethylbenzene, about six point two five percent (6.25%) iso-pentane, about four percent (4%) n-butane, two point seven percent (2.7%) m-toluidine, and about two point one percent (2.1%) of residual hydrocarbons including various components in minor amounts as might be expected as a result of normal hydrocarbon manufacturing processes. A six (6) cylinder, five hundred fifty (550) cubic inch displacement spark ignition reciprocating aircraft piston engine was operated at about two hundred ninety six (296) brake horsepower using the novel unleaded aviation gasoline blend. Some of the operating conditions during testing are set forth below in Table 2. The knock index averages observed in the various cylinders were functionally equivalent as between the locally purchased FBO Grade 100LL avgas having a selected MON and the novel unleaded aviation gasoline blend, which has been designated in the chart below as "G100UL Xylene Based Unleaded AVGAS". Each of the six cylinders exhibited very similar Detonation Index Average Numbers, when switched from operation on the novel unleaded aviation gasoline to operation on the FBO Grade 100LL fuels. Thus, the novel unleaded aviation gasoline blend set forth above and having performance as noted in Table 2 has a "Full Scale Engine Equivalent MON" equal to the MON of the FBO Grade 100LL avgas against which it was tested. Consistently over many months, I have observed the typical FBO Grade 100LL delivered in normal commerce to the facility used for testing to have an ASTM D2700 test motor octane number (MON) of approximately 102.5.

TABLE 2

| Fuel | Manifold Pressure | RPM | Hot CHT | Induction Air Temp | Brake Hp | Fuel Flow GPH | Fuel Flow Corrected For Energy Density | BMEP |
|---|---|---|---|---|---|---|---|---|
| FBO 100LL | 35.3 | 2374 | 444 | 153 | 302 | 20.7 | 20.7 | 183 |
| G100UL Xylene Based Unleaded AVGAS Measured MON 100.5 | 35.3 | 2373 | 441 | 162 | 296 | 20.0 | 20.7 | 179 |

Note that the novel unleaded aviation gasoline blend set forth in Example D utilized a small amount of m-toluidine for octane enhancement properties. While it may be possible to avoid use of aromatic amines such as m-toluidine when certain compounds having methyl groups at meta-ring locations are included at a relatively high percentage in a final blend (such as 1,3,5-trimethylbenzene), the use of such aromatic amines may be useful in an unleaded aviation gasoline fuel blend manufacturing and production environment to "trim" the final unleaded aviation gasoline fuel blend so as to increase the overall knock performance of the fuel in order to meet a desired full scale engine knock resistance. In this regard, in some embodiments it may be useful to define the knock resistance in terms of "full scale engine equivalent motor octane number" or "FSEEMON". In such a context, and as elsewhere discussed herein, the term "FSEEMON" should be understood to mean the comparative detonation performance seen when a selected fuel is tested in a full scale engine, as against performance demonstrated under the same conditions (preferably in the same or identical engines) by a selected FBO Grade 100LL fuel of selected MON, when the testing proceeds using standard ASTM test procedures at detonation performance conditions of forty (40) BAR, or more, when using the ASTM D6424 algorithm to quantify detonation intensity. In an embodiment, it should also be possible to avoid, or minimize, or at least optimize, the amount of one or more aromatic amines that might be necessary to add to such unleaded aviation gasoline base fuel in order to achieve performance equivalent to a desired motor octane number of an FBO Grade 100LL fuel, in a final unleaded aviation gasoline blend as taught herein. In any event, a range of aromatic amines, such as meta-toluidine ("m-toluidine"), may be useful for enhancing or trimming the final FSEEMON will be between 1% and 6% by weight. Such addition, if by way of m-toluidine, will be useful to increase the FSEEMON by between approximately 0.5 and 4 MON points, depending on the particular composition of the base fuel, or intermediate unleaded aviation gasoline fuel blend to which such aromatic amine(s) are added. In various embodiments, one or more aromatic amines may be utilized by an avgas manufacturer in a method of manufacturing an unleaded aviation gasoline blend to increase the MON, in order to provide a "knock value, as Motor Octane Number (MON) of at least 99.6, as measured by the ASTM D2700 Test Method. Thus, in an embodiment, addition of aromatic amine(s) may be useful for increasing the knock resistance of the unleaded aviation gasoline blend, and thus increase both the FSEEMON and the MON of a final unleaded aviation gasoline blend.

In an embodiment, the amount of aromatic amines provided may be somewhere in the range from about zero percent, or from more than zero percent (+0%) up to a maximum of about four point five percent (4.5%) by weight in the final unleaded aviation gasoline blend. If so used, suitable aromatic amines may have the formula.

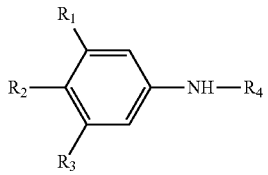

wherein $R_1$, $R_2$, $R_3$ and $R_4$ are hydrogen or a $C_1$-$C_3$ alkyl group.

In an embodiment, a single aromatic amine may be selected for use in a high octane unleaded aviation gasoline blend. In an embodiment, a suitable aromatic amine may be meta-toluidine (m-toluidine):

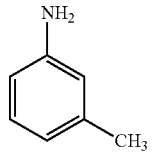

In an embodiment, a synergistic blend of 1,3,5-trimethylbenzene and m-toluidine may be utilized in combination with a suitable unleaded aviation base fuel to provide a final unleaded aviation gasoline blend that meets or exceeds the detonation performance of an FBO Grade 100LL avgas having a selected MON, when the aviation fuel blend is tested in a full scale aircraft engine.

In yet another embodiment, a synergistic blend of xylenes (including 1,3-dimethylbenzene) and m-toluidine may be utilized in combination with a suitable aviation base fuel to provide a final unleaded aviation gasoline blend that meets or exceeds the detonation performance of an FBO Grade 100LL avgas having a selected MON, when the aviation fuel blend is tested in a full scale aircraft engine. Similarly, in various embodiments, a synergistic blend of xylenes (including 1,3-dimethylbenzene) and m-toluidine may be utilized by an avgas manufacturer in a method of manufacturing unleaded avgas to increase the MON, in order to provide a "knock value, as Motor Octane Number (MON) of at least 99.6, as measured by the ASTM D2700 Test Method.

Various mixtures of the dialkylated and/or trialkylated benzenes may be used in connection with one or more aromatic amines. In other embodiments for unleaded aviation gasoline blends, monoalkylated benzenes may be utilized. For example, in an embodiment, various aromatic hydrocarbons may be used, supplemental to the aforementioned 1,3-dimethylbenzene, as an octane enhancer for a novel unleaded aviation gasoline blend. In an embodiment, aliphatic aromatic hydrocarbons of commercial interest and which may be considered environmentally acceptable as octane enhancers include methylbenzene (also known as toluene), and 1,4-dimethylbenzene (also known as para-xylene). In an embodiment, mixtures of 1,2-dimethylbenzene (ortho-xylene) and 1,4-dimethylbenzene (para-xylene) mixtures of roughly equal proportions may be utilized for octane enhancers. However, increased amounts of 1,4-dimethylbenzene (or especially 1,3-dimethylbenzene) are preferable to increased amounts of 1,2-dimethylbenzene. In an embodiment, commercially available xylol solvent mixtures including some or all of the various xylene isomers, namely 1,2-dimethylbenzene, 1,3-dimethylbenzene, and 1,4-dimethylbenzene (also known as ortho-xylene, meta-xylene, and para-xylene, respectively), as well as significant amounts of ethylbenzene, may be utilized. In an embodiment, toluene (methybenzene), may be utilized in an amount up to a maximum of about ten percent (10%) by weight. In an embodiment, trimethylbenzenes may be used wherein the total amount of trimethylbenzenes present in such unleaded aviation gasoline blend is anywhere from zero percent (0%) up to a maximum amount of about forty five percent (45%) by weight. In an embodiment, xylenes may be used wherein the total 1,3-dimethylbenzene, and 1,4-dimethylbenzene (meta-xylene, and para-xylene, respectively) present in such unleaded aviation gasoline blend is anywhere up to a maximum amount of about forty five percent (45%) by weight. In an embodiment, xylenes may be used wherein the total of 1,4-dimethylbenzene (para-xylene) present in such unleaded aviation gasoline blend is anywhere up to a maximum amount of about thirteen percent (13%) by weight. In an embodiment, xylenes may be used wherein the total amount of 1,2-dimethylbenzene (ortho-xylene) present in such unleaded aviation gasoline blend is anywhere up to a maximum amount of about eleven percent (11%) by weight. In an embodiment, ethylbenzene may be used wherein the total amount of ethylbenzene present in such unleaded aviation gasoline blend is anywhere up to a maximum amount of about eight percent (8%) by weight.

Overall, various embodiments for unleaded aviation gasoline blends having a Motor Octane Number (MON) of ninety nine point six (99.6) or more have been found workable wherein the total amount of permitted aromatics and aromatic compounds are provided in at least thirty seven percent (37%) by weight, and not more than about fifty one percent (51%) by weight, of the unleaded aviation gasoline blend. Further, such fuels have been found to have an ASTM D909 supercharge rating of 130 or more, and often of 150 or more. More explicitly, in various embodiments, it has been found that in addition to the maximum amounts just stated in the just preceding paragraph with respect to (1) toluene (at 10% maximum), (2) meta-xylene+para-xylene (at 45% maximum), (3) para-xylene (at 13% maximum), (4) ortho-xylene (at 11% maximum), (5) ethylbenzene (at 8% maximum), and (5) m-toluidine (at 4.5% maximum), other aromatic compounds should not be present in excess of about four percent (4%). Such "other aromatic compounds" generally are limited to about four percent (4%) by weight in the unleaded aviation gasoline blend, and is considered to include only those compounds that are typically found in small concentrations associated with the volume production of the aromatics otherwise identified in this paragraph, as well as other aromatics found in aviation gasoline conforming to ASTM Standard D910.

Various products from refining operations may vary widely depending on the manufacturer. For example, refinery run iso-octane may vary in composition from refinery to refinery. Similarly, refinery run high grade aviation alkylates may vary in composition from refinery to refinery. And, producers of xylenes may have various end compositions in their output products, and other compounds may be found in such products, depending on equipment used for the production, and on the specifications of their various customers. However, one useful commercial xylol mixture useful for the manufacture of unleaded aviation gasoline blends have been found to include about twenty percent (20%) by weight of 1,4-dimethylbenzene, about fourteen percent (14%) of 1,2-dimethylbenzene, about forty four percent (44%) of 1,3-dimethylbenzene, and about twenty two percent (22%) of ethylbenzene. However, it must be appreciated that other ranges of such xylol mixture components may be used to prepare novel unleaded aviation gasoline blends as described herein. And, other aliphatic aromatic hydrocarbons may be useful, with usage adjustable according to performance and economic objectives sought for a particular final unleaded aviation gasoline blend.

In most circumstances, FBO Grade 100LL avgas (as discussed elsewhere herein), typically has a MON in excess of the minimum MON required by the applicable ASTM Standard D910. Companies selling avgas typically include a small "MON quality giveaway" to assure that the avgas, at the pump, exceeds the minimum ASTM specifications. Thus, the MON of a FBO Grade 100LL may actually be found, upon sampling and testing, to be in the range of from about 100 to about 105, but more often in the middle of such range. However, the MON of a FBO Grade 100LL may be seen with values of 100, or 100.5, or 101, or 101.5, or 102, or 102.5, or 103, or more. Thus, economics may guide the final blend ratios utilized by a manufacturer of the unleaded aviation gasoline blends described herein in producing an unleaded aviation gasoline blend having a desired final MON, and a desired final supercharge rating. In other words, more or less of a selected monoalkylated benzene, dialkylated benzene, or trialkylated benzene such as 1,3,5-trimethylbenzene may be used in manufacture of an unleaded aviation gasoline blend, depending upon the actual amount and composition of alklyated benzenes utilized, and which aromatic amine(s) are selected, such as m-toluidine, how much of the selected aromatic amines(s) are used, in the final unleaded aviation gasoline blend.

In various formulations, an effective amount of 1,3,5-trimethylbenzene may be at least about twenty percent (20%) by weight of a final unleaded aviation gasoline blend. In some formulations, to further increase the selected MON of the final unleaded aviation gasoline blend, an effective amount of 1,3,5-trimethylbenzene may be at least about thirty percent (30%) of the final unleaded fuel blend. However, when trimethybenzenes are used, in an embodiment, it is currently anticipated that the amount of 1,3,5-trimethylbenzene utilized will be about forty five percent (45%) by weight or less of the final unleaded aviation gasoline blend.

In an embodiment, it may be anticipated that a final unleaded aviation gasoline blend will include about sixty percent (60%) to about seventy percent (70%) by weight of an unleaded aviation gasoline base fuel, and about forty percent (40%) to about thirty percent (30%) by weight of 1,3,5-trimethylbenzene.

Various unleaded aviation gasoline base fuels may be suitable to provide the novel unleaded aviation gasoline blends and the accompanying results described herein. For example, a high grade aviation alkylate may be a useful base fuel, or a commercial grade iso-octane may be a useful base fuel.

A mixture of a high grade aviation alkylate enhanced by addition of a portion of a commercial grade iso-octane may be a useful base fuel. As an example, an unleaded gasoline base fuel including (by weight) about twenty percent (20%) to about ninety percent (90%) of iso-octane, about one percent (1%) to about twenty percent (20%) of $C_4$ to $C_5$ paraffins, and the balance being primarily light alkylates, would be suitable. In an embodiment, providing iso-octane at about eighty percent (80%) has been found to be suitable. In an embodiment, a paraffin composition in the ten percent (10%) to twenty percent (20%) range by weight, in the unleaded aviation base fuel, is anticipated to be suitable. In an embodiment, iso-pentane may be used as the paraffin of choice. In such case, iso-pentane in the unleaded aviation gasoline base fuel of about fifteen percent (15%) has been found to be suitable. In various embodiments, it may be desirable to add butane or iso-butane, to achieve distillation curve or vapor pressure objectives, to produce an exemplary unleaded aviation gasoline gasoline.

Various unleaded aviation gasoline base fuels are available from various refineries, and in various embodiments of an unleaded aviation gasoline blend as taught herein, variations on the motor octane number (MON) of the aviation gasoline base fuels are anticipated to be workable. For example, in an embodiment, a 95 MON unleaded base fuel is known by my experiments to be workable, by blending an effective amount of 1,3-dimethylbenzene to the base fuel to provide an unleaded aviation gasoline blend meeting the performance objectives as set forth and claimed herein, which in an embodiment include detonation performance equivalent to, or better than, the full scale engine detonation performance of a Grade 100LL fuel that meets the minimum octane rating requirements set forth in ASTM Standard D910. And, in another embodiment, such objectives include detonation performance in a full scale engine equivalent to (FSEEMON), or better than, the full scale engine detonation performance of a selected FBO Grade 100LL fuel having a selected MON. In an embodiment, addition of minor amount of aliphatic aromatic hydrocarbons may be provided, and such mixtures would preferably include such compounds as may enhance the octane performance of the final unleaded aviation gasoline fuel blend. Similarly, it is anticipated that use of a 94 MON base fuel will provide advantageous results, when used with somewhat increased proportions of 1,3-dimethylbenzene, and/or slightly increased proportions of a selected additional alkyl benzene or other aliphatic aromatic hydrocarbon, especially some of the above mentioned compounds that provide octane enhancing properties.

In an embodiment, a novel unleaded fuel blend may include major components of (a) iso-octane, (b) one or more di-alkylated or tri-alkylated benzenes, and (c) minor components including one or more linear paraffins with five or less carbon atoms. In an embodiment, such linear paraffins may comprise butane.

Although various di-alkylated or tri-alkylated benzenes may be included in the novel unleaded aviation gasoline blends described herein, including various examples mentioned herein (for example, as occur in refinery runs of various compounds, including xylol mixtures). Nonetheless I have found that useful novel unleaded aviation gasoline blends might preferably include, as a significant constituent thereof, certain di-alkylated and/or tri-alkylated benzenes selected from those having the following general structural formula:

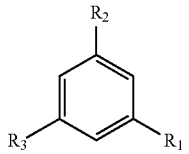

wherein $R_1$, $R_2$, and $R_3$ are selected from the group consisting of hydrogen and alkyl groups having one or more carbon atoms. In an embodiment, $R_1$, $R_2$, and $R_3$ are selected from the group consisting of one to two carbon atoms. In an embodiment, at least one of $R_1$, $R_2$ and $R_3$ consists of hydrogen, and the alkylated benzene is a di-alkylated benzene. In an embodiment, each of $R_1$, $R_2$ and $R_3$ are methyl groups, and thus the alkylated benzene is 1,3,5-trimethylbenzene. In an embodiment, one of $R_1$, $R_2$, and $R_3$ consists of hydrogen, and the remainder of $R_1$, $R_2$ and $R_3$ are methyl groups. In such example, the alkylated benzene is a dimethylbenzene (also known as a xylene). In an embodiment, such xylenes may comprise 1,4-dimethylbenzene. In an embodiment, an unleaded aviation gasoline blend comprises alkylated benzenes wherein one of $R_1$, $R_2$, and $R_3$ consists of hydrogen, and the remainder of $R_1$, $R_2$ and $R_3$ are methyl groups in the meta-ring position, and in such embodiment, the meta-ring compound is 1,3-dimethylbenzene.

In an embodiment, an effective amount of 1,3-dimethylbenzene (meta-xylene) may be present up to about forty five percent (45%) by weight, more or less, in a final unleaded aviation gasoline blend, depending up on presence (or absence) of sufficient other octane enhancing compounds, as necessary to reach a selected FSEEMON.

As an Example 1, in an embodiment, it may be anticipated that a useful final unleaded aviation gasoline blend will include:

(a) about sixty percent (60%) to about forty percent (40%) by weight of an unleaded aviation gasoline base fuel;
(b) about thirty percent (30%) to about fifty one percent (51%) by weight of one or more di-alkylated or tri-alkylated benzenes; and
(c) about one percent (1%) to about fifteen percent (15%) by weight of one or more selected linear paraffin hydrocarbons.

As an Example 2, in yet another embodiment, it may be anticipated that a useful final unleaded aviation gasoline blend will include:

(a) about fifty five percent (55%) to about forty five percent (45%) by weight of an unleaded aviation gasoline base fuel;
(b) about thirty eight percent (38%) to about fifty percent (50%) by weight of one or more di-alkylated or tri-alkylated benzenes; and
(c) about one percent (1%) to about fifteen percent (15%) by weight of one or more selected linear paraffin hydrocarbons.

As an Example 3, in yet another more specific formulation, it may be anticipated that a useful final unleaded aviation gasoline blend will include:

(a) about sixty percent (60%) to about forty percent (40%) by weight of an unleaded aviation gasoline base fuel;
(b) about thirty eight percent (38%) by weight of one or more di-alkylated or tri-alkylated benzenes;
(c) about one percent (1%) to about fifteen percent (15%) by weight of one or more selected linear paraffin hydrocarbons.

As an Example 4, in yet another more specific formulation, it may be anticipated that a useful final unleaded aviation gasoline blend will include:

(a) about fifty four percent (54%) by weight of an unleaded aviation gasoline base fuel;

(b) about forty five percent (45%) by weight of 1,3-dimethylbenzene, and (c) about one percent (1%) to about fifteen percent (15%) by weight of one or more selected linear paraffin hydrocarbons.

As an Example 5, in yet another more specific formulation, it may be anticipated that a useful final unleaded aviation gasoline blend will include:

(a) about forty five percent (45%) by weight of an unleaded aviation gasoline base fuel;

(b) about fifty five percent (55%) by weight of one or more di-alkylated or tri-alkylated benzenes;

(c) more than zero percent (0%) to about six percent (6%) by weight of an aromatic amine.

As an Example 6, in yet another more specific formulation, it may be anticipated that a useful final unleaded aviation gasoline blend will include:

(a) about forty five percent (45%) by weight of an unleaded aviation gasoline base fuel;

(b) about fifty five percent (55%) by weight of 1,3-dimethylbenzene;

(c) more than zero percent (0%) to about six percent (6%) by weight of meta-toluidine.

As an Example 7, in an embodiment, it has been found that an exemplary unleaded aviation gasoline blend can be provided using in the formulation, by weight:

(a) about fifty four percent of an aviation base fuel, the aviation base fuel having a MON of about 95-96, and having primary components of about seventy nine percent (79%) iso-octane and about fifteen percent (15%) iso-pentane, by weight;

(b) about forty five percent (45%) 1,3-dimethylbenzene; and (c) about one percent (1%) butane.

As an Example 8, in an embodiment, it has been found that an exemplary unleaded aviation gasoline blend can be provided using in the formulation, by weight, about thirty four percent (34%) of iso-octane (2,2,4-trimethylpentane), about forty four percent (44%) of a mixture of 1,4-dimethylbenzene and 1,3-dimethylbenzene, about four and one-half percent (4.5%) of 1,2-dimethylbenzene, about six percent (6%) isopentane, about three and one-half percent (3.5%) n-butane, two percent (2%) m-toluidine, and about one half percent (0.5%) of tolulene, with the remainder various components in minor amounts as might be expected as a result of normal hydrocarbon manufacturing processes.

As another Example 9, a useful unleaded aviation gasoline blend may include, by weight percent, (a) about thirty three point seven percent (33.7%) of iso-octane (2,2,4-trimethylpentane), (b) about forty four point four (44.4%) percent of a blend of 1,3-dimethylbenzene and 1,4-dimethylbenzene (also known as meta-xylene, and para-xylene, respectively), (c) about four point five percent (4.5%) of 1,2-dimethylbenzene (also known as ortho-xylene), (d) about two point eight percent (2.8%) ethylbenzene, (e) about two point one percent (2.1%) m-toluidine, (f) from about five percent (5%) to about ten percent (10%) iso-pentane, (g) more than zero (+0%) to about five percent (5%) n-butane, and (h) more than zero (+0%) to about five percent (5%) residual hydrocarbons including various components in minor amounts as might be expected as a result of normal hydrocarbon manufacturing processes.

As yet another Example 10, a useful unleaded aviation gasoline blend may include, by weight percent, (a) about thirty four point two seven percent (34.27%) of iso-octane (2,2,4-trimethylpentane), (b) about forty four point four (44.2%) percent of a blend of 1,3-dimethylbenzene and 1,4-dimethylbenzene (also known as meta-xylene, and para-xylene, respectively), (c) about three point nine percent (3.9%) of 1,2-dimethylbenzene (also known as ortho-xylene), (d) about three point eight percent (3.8%) ethylbenzene, (e) about four point three percent (4.3%) m-toluidine, (f) from about five percent (5%) to about ten percent (10%) iso-pentane, and (g) more than zero (+0%) to about five percent (5%) n-butane, and (h) more than zero (+0%) to about five percent (5%) residual hydrocarbons including various components in minor amounts as might be expected as a result of normal hydrocarbon manufacturing processes.

More generally, as yet another Example 11, useful unleaded aviation gasoline fuel blends may include, by weight percent, (a) about thirty percent (30%) to about forty five percent (45%) of iso-octane (2,2,4-trimethylpentane), (b) about thirty percent (30%) to about forty five percent (45%) percent of a blend of 1,3-dimethylbenzene and 1,4-dimethylbenzene (also known as meta-xylene, and para-xylene, respectively), (c) about more than zero percent (+0%) to about ten percent (10%) of 1,2-dimethylbenzene (also known as ortho-xylene), (d) more than zero percent (+0%) to about eight percent (8%) ethylbenzene, (e) about one percent (1%) to about four point five percent (4.5%) m-toluidine, (f) from about five percent (5%) to about ten percent (10%) iso-pentane, and (g) more than zero (+0%) to about five percent (5%) n-butane, and (h) more than zero (+0%) to about five percent (5%) residual hydrocarbons including various components in minor amounts as might be expected as a result of normal hydrocarbon manufacturing processes.

Even more generally, as another useful Example 12, unleaded aviation gasoline fuel blends may include, by weight percent, (a) about thirty percent (30%) to about forty five percent (45%) of commercial iso-octane (2,2,4-trimethylpentane), (b) about thirty percent (30%) to about forty five percent (45%) percent of one or more di-alkylated or tri-alkylated benzenes, (c) about more than zero percent (+0%) to about ten percent (10%) of 1,2-dimethylbenzene (also known as ortho-xylene), (d) more than zero percent (+0%) to about eight percent (8%) ethylbenzene, (e) about one percent (1%) to about four point five percent (4.5%) m-toluidine, (f) from about five percent (5%) to about ten percent (10%) iso-pentane, and (g) more than zero (+0%) to about five percent (5%) butane (e.g., n-butane, iso-butane, or a mixture thereof), and (h) more than zero (+0%) to about five percent (5%) residual hydrocarbons including various components in minor amounts as might be expected as a result of normal hydrocarbon manufacturing processes. In an embodiment, when tri-alkylated benzenes are utilized, the composition may be limited to about forty five percent (45%), or less of tri-alkylated benzenes. For example, when 1,3,5-trimethylbenzene is used, then the amount of 1,3,5-trimethylbenzene may be limited to a maximum of forty five percent (45%) of the unleaded aviation gasoline fuel blend. In an example, when toluene (methylbenzene) is utilized, then the amount of toluene present may be limited to a maximum of ten percent (10%) of the unleaded aviation gasoline blend. In an example, when a blend of 1,3-dimethylbenzene and 1,4-dimethylbenzene (also known as meta-xylene, and para-xylene) is utilized, then the amount of the sum of 1,3-dimethylbenzene and 1,4-dimethylbenzene present in the blend may be limited to about forty five percent (45%) percent by weight of the unleaded aviation gasoline fuel blend.

In the various examples just mentioned, where not otherwise already specified, methylbenzene (toluene) may be utilized as one of the one or more additional alkylated benzenes. Also, in the various examples just mentioned, where not otherwise already specified, where necessary or required for assuring adequate Reid Vapor Pressure of a final unleaded aviation gasoline fuel blend to meet applicable specifications or service conditions, a suitable unleaded aviation gasoline blend may further include more than zero percent (0%) up to about five percent (5%) butane, by weight. In an embodiment, a selected butane, such as n-butane, may be added so that an unleaded aviation gasoline has a vapor pressure at 38° C., between a minimum of 38 kPa and a maximum of 49 kPa, per applicable ASTM test methods. Also, constituents such as iso-pentane or other paraffins may be provided. For example, as a supplement to amounts already in some unleaded aviation gasoline base fuels, amounts of more than zero percent (0%) up to about five percent (5%) of additional $C_5$-$C_6$ paraffins may be added. In an embodiment, because of its relatively low boiling point, iso-pentane may be selected for further addition to complete a workable, high performance, final unleaded aviation gasoline blend.

To assure usability of the unleaded aviation gasoline described herein at low temperatures, the amount of para-xylene may be limited to about thirteen percent (13%) by weight. In an embodiment, the amount of ortho-xylene may be limited to a maximum of about eleven percent (11%) by weight. In various embodiments, many of the unleaded aviation gasoline fuel blends described herein will have freezing point of −58° C., or less. In this regard, during testing, if no crystals have been observed as at time of cooling to −58° C., the freezing point is normally simply reported as less than −58° C. The freezing point is of note as regards use of m-toluidine, since in the past, practices in the fuels industry had taught away from the use of m-toluidine, especially at concentrations greater than about three (3%) or so, since in other aviation fuel formulations lacking the aromatic content as described herein, the m-toluidine would tend to come out of solution in extremely cold temperatures. However, it has been observed that co-solvency of the m-toluidine with other aromatics present—particularly when the total of permitted aromatics and aromatic compounds (see discussion above) range from a minimum of about thirty seven percent (37%) by weight to about fifty one percent (51%) by weight—allows the use of higher levels of m-toluidine, say up to as much as in the five percent (5%) or six percent (6%) by weight, depending on other constituents present. However, based on the just noted range for the total of permitted aromatics and aromatic compounds, use of m-toluidine at an amount from zero percent (+0%)—where unnecessary to other constituents—up to a maximum of four point five percent (4.5%), has been found workable.

In the unleaded aviation gasoline fuel blends tested as noted above, based on currently available test information, it is believed that one specific advantageous final unleaded aviation gasoline blend will include (a) about fifty four percent (54%) by weight of unleaded aviation gasoline base fuel, (b) about forty five percent (45%) by weight of 1,3-dimethylbenzene, and (c) about one percent (1%) by weight of butane. Such a formulation has been demonstrated to provide detonation performance of the unleaded aviation gasoline blend to be the functional equivalent of the detonation performance when operated on a full scale aircraft engine (the FSEEMON) of a selected FBO Grade 100LL avgas having a selected MON. Notably, FBO Grade 100LL avgas is considered to provide better performance than a Grade 100LL avgas that merely meets the minimum octane rating requirements set forth in ASTM Standard D910.

Availability of a novel unleaded aviation gasoline fuel blend having a functional performance as good or better than traditional aviation gasoline fuels with a motor octane number (MON) of 99.6, or more, which blend provides full scale aircraft piston engine detonation performance as good as, or better than, that currently available using Grade 100LL fuels which minimally meet the MON standards of ASTM Standard D910, will be of considerable interest to a large number of users of high performance aircraft piston engines. Moreover, availability of a novel unleaded aviation gasoline blend effective to increase the detonation performance of the unleaded aviation gasoline fuel blend to an equivalent (the FSEEMON of the unleaded aviation gasoline fuel blend), or better, when tested in a full scale aircraft engine, compared to the detonation performance of a selected FBO Grade 100LL avgas having a selected MON, will be of even more interest to users of high performance aircraft piston engines. This is especially notable, since although various alkylbenzenes have long been utilized in various fuels, in so far as I am aware, mixtures using relatively high amounts of suitable octane enhancing alkylbenzenes, particularly those including meta-ring position methyl groups such as those described herein, have not been evaluated on full scale aircraft engines sufficiently to appreciate the FSEEMON advantage evident, compared to FBO Grade 100LL fuels of selected MON. The perceived general knowledge in the industry that unleaded fuels would underperform on full scale aircraft engines leaded fuels of the same or similar ASTM D2700 MON during detonation testing, based on lab testing, also led to the failure of others to fully investigate the detonation performance of unleaded fuels at actual engine operating conditions at moderate and heavy detonation intensity levels as determined by the ASTM D6424 algorithm.

In yet a further embodiment, a method for manufacturing a composition of matter as an unleaded aviation gasoline fuel blend is disclosed. Such method may be accomplished by blending (a) an unleaded aviation gasoline base fuel having a selected motor octane number (MON), with (b) a selected amount of one or more alkylated benzenes, to increase the detonation performance of the unleaded aviation gasoline fuel blend to an equivalent, or better, compared to the detonation performance of Grade 100LL avgas that meets the minimum octane rating requirements set forth in ASTM Standard D910. In an embodiment, the selected motor octane number of the unleaded aviation gasoline base fuel may be provided having a motor octane number (MON) of 94, or better. In an embodiment, such a method may include providing an unleaded aviation gasoline base fuel having, by weight, (a) about twenty percent (20%) to about ninety percent (90%) of iso-octane, (b) about one percent (1%) to about twenty percent (20%) of $C_4$ to $C_5$ paraffins, and (c) the balance being primarily light alkylates. In an embodiment, the $C_5$ paraffins may include iso-pentane. Further, various embodiments are feasible, as set forth above with respect to various percentages of blend components, and with respect to the specific formulation that have been tested. And, as noted above, where necessary or required for assuring adequate Reid Vapor Pressure of a final unleaded aviation gasoline blend to meet applicable specifications or service conditions, a suitable unleaded aviation gasoline fuel blend may be manufactured by including more than zero percent (0%) up to about five percent (5%) butane, by weight. Also, for the same purpose, in addition to any iso-pentane or other paraffins that may be present in the aviation base fuel, amounts of more than zero percent (0%) up to about five percent (5%) additional $C_5$-$C_6$ paraffins can be added. For example, to manufacture any one of the embodiments set forth in the various examples, iso-pentane may be provided to complete a workable, high performance, final unleaded aviation gasoline fuel blend.

In yet another embodiment, it should be noted that a method is disclosed for operating a piston driven aircraft engine. Such method includes operating the piston driven aircraft engine with an unleaded aviation gasoline blend composition as set forth in any one of the novel unleaded aviation gasoline fuel blend compositions described herein. For example, such method may include combusting in such an engine an unleaded aviation gasoline blend manufactured using an unleaded aviation gasoline base fuel having a selected motor octane number (MON) of at least 94, and an amount of one or more selected di-alkylated or tri-alkylated benzenes effective to increase the detonation performance of the unleaded aviation gasoline blend to an equivalent, or better, compared to the detonation performance of Grade 100LL avgas that meets the minimum octane rating requirements set forth in ASTM Standard D910. In an embodiment, the amount of one or more selected alkylated benzenes in the unleaded aviation gasoline blend used in the method will be effective to increase the detonation performance of the unleaded aviation gasoline blend to an equivalent (the FSEEMON of the unleaded aviation gasoline fuel blend), or better, when tested in a full scale aircraft engine, compared to the detonation performance of a selected FBO Grade 100LL avgas having a selected MON, when evaluated at detonation performance conditions of forty (40) BAR, or more, when using the ASTM D6424 algorithm. In an embodiment, alkylated benzenes suitable for use in such method may include those having at least two methyl groups at the meta-ring positions. In an embodiment, a suitable alkyl benzene may be provided using 1,3-dimethylbenzene. In an embodiment, a suitable alkyl benzene may be provided using 1,3,5-trimethylbenzene. In an embodiment, a suitable mix of alkylbenzenes may be provided using both 1,3-dimethylbenzene and 1,3,5-trimethylbenzene. In an embodiment, in addition to using both 1,3-dimethylbenzene and 1,3,5-trimethylbenzene, other xylenes, or constituents from xylol mixtures may be used, including 1,4-dimethylbenzene, 1,2-dimethylbenzene, and ethylbenzene.

In a method of using novel unleaded aviation gasoline fuel blends, the unleaded aviation gasoline base fuel may include, by weight, (a) about twenty percent (20%) to about ninety percent (90%) of iso-octane, (b) about one percent (1%) to about twenty percent (20%) of $C_4$ to $C_5$ paraffins, and (c) the balance being primarily light alkylates. In an embodiment, the $C_5$ paraffins may include iso-pentane. Further, various embodiments are feasible for use in a method of operating aircraft engines, using unleaded aviation gasoline fuel blends as set forth above with respect to various percentages of blend components, or with respect to the more specific formulations noted above. And, where necessary or required for assuring adequate Reid Vapor Pressure of a final unleaded aviation gasoline blend to meet applicable specifications or service conditions, unleaded aviation gasoline fuel blends having more than zero percent (0%) up to about five percent (5%) butane, by weight may be utilized. Also, for the same purpose, in addition to any iso-pentane or other paraffins that may be present in the aviation base fuel, using amounts of more than zero percent (0%) up to about five percent (5%) additional $C_5$-$C_6$ paraffins can be useful in practice of the method. For example, an unleaded aviation gasoline fuel blend that may be used in aircraft engines may be provided in accord with any one of the embodiments set forth herein, using iso-pentane to complete a workable, high performance, final unleaded aviation gasoline blend for use in operation of aircraft engines.

In yet another embodiment, using an existing aircraft engine mechanically designed for use by combustion of a fuel having 99.6 motor octane number (MON) or better leaded aviation gasoline, where the engine utilizes a spark ignition system with pistons in cylinders, a method is provided for drop-in substitution of such leaded aviation gasoline with an unleaded aviation gasoline fuel blend as described herein. In an embodiment, an unleaded aviation gasoline may include (a) an aviation gasoline base fuel, as described above, (b) a selected amount of one or more mono alkalyated benzenes, (c) a selected amount of one or more di-alkylated benzenes, (d) a selected amount of one or more tri-alkylated benzenes, and (e) a selected amount of meta-toluidine, from more than zero percent (+0% to a maximum of about four point five percent (4.5%). In an embodiment, the total amount of (1) the mono alkylated amines, (2) the di-alkylated amines, (3) the trialkylated amines, and (4) the meta-toluidine, may be between about thirty seven percent (37%) and about fifty one percent (51%) by weight of the high octane unleaded aviation gasoline. In an embodiment, the selected unleaded aviation gasoline base fuel may have a selected motor octane number (MON) of at least 94. In an embodiment, an amount of meta-xylene (1,3-dimethylbenzene) and para-xylene (1,4-dimethylbenzene) is provided in an amount up to a maximum of about forty five percent (45%) of the unleaded aviation gasoline. In an embodiment, the amount of meta-xylene and para-xylene provided may be effective to increase the detonation performance on a full scale aircraft engine of the unleaded aviation gasoline fuel blend to an equivalent, or better, compared to the detonation performance of Grade 100LL avgas that meets the minimum octane rating requirements set forth in ASTM Standard D910. In an embodiment, an amount of one or more selected alkylated benzenes included in the unleaded aviation gasoline will be effective to increase the detonation performance of the unleaded aviation gasoline to an equivalent (the FSEEMON of the unleaded aviation gasoline), or better, when tested in a full scale aircraft engine, compared to the detonation performance of a selected FBO Grade 100LL avgas having a selected MON. And, in an embodiment, the unleaded aviation gasoline base fuel may include, by weight, (a) about twenty percent (20%) to about ninety percent (90%) of iso-octane, (b) from about nine percent (9%) to about fifteen percent (15%) of a selected aliphatic aromatic hydrocarbon octane enhancer, and (c) about one percent (1%) to about twenty percent (20%) of $C_4$ to $C_5$ paraffins, and (d) the balance being primarily light alkylates. In an embodiment, an embodiment for an unleaded aviation gasoline as described herein, as used in a method of drop-in-substitution in an existing engine, may have a motor octane number (MON) of at least 99.6, and a rich mixture performance number of at least 130.

In an embodiment, the unleaded aviation gasoline fuel blend just described for use in the method of drop-in-substitution in an existing engine may include blends as set forth in any of the Examples above, or within the ranges set forth in the claims as regards composition of the claimed unleaded aviation gasoline, with respect to various percentages of components, or with respect to the more specific formulations. As mentioned above, where necessary or required for assuring adequate Reid Vapor Pressure of a final unleaded aviation gasoline blend to meet applicable specifications or service conditions, unleaded aviation gasoline fuel blends having more than zero percent (0%) up to about five percent (5%) butane, by weight may be utilized. Also, for the same purpose, in addition to any iso-pentane or other paraffins that may be present in the aviation base fuel, using amounts of more than zero percent (0%) up to about five percent (5%) additional $C_5$-$C_6$ paraffins can be useful in practice of the method. And, for use as drop-in fuel, an unleaded aviation gasoline may be provided as set forth in selected embodiments in Examples above, adding where appropriate additional iso-pentane to complete a workable, high performance, final unleaded aviation gasoline for use in operation of aircraft engines.

Further, with respect to drop-in operation of the new high octane aviation gasoline in aircraft engines, it must be noted, as mentioned above, that in various embodiments, the novel high octane aviation gasoline described herein, although to be manufactured without lead addition, allows for lead at levels of up to 0.013 g of lead per liter or less as at time of manufacture. As such, those small amounts of lead may be considered to be an incidental contaminant, and such incidental contamination with lead may be present when practicing the method of operation of an aircraft engine. Further, and more important as a practical matter, the unleaded aviation gasoline as described herein (whether with or without incidental contamination) may be mixed with an otherwise approved leaded gasoline (in any proportions) for use in the field. For example, aircraft fuel tanks may have quantities of leaded fuels therein, yet, may fill up with the unleaded aviation gasoline described herein, and operate the aircraft engine in the method described. In the opposite situation, where an aircraft may land with partially empty tanks containing the unleaded aviation gasoline as described herein, a prior grade of fuel, such as Grade 100LL or Grade 100VLL may be added to and thus mixed with the remaining unleaded aviation gasoline, and the aircraft may operate as though the change of fuel blend composition is practically invisible. As noted in the method claims below, such mixtures of the present unleaded aviation gasoline and the prior art grades of fuel are described as changeover contamination with lead—that is, mixing that occurs during use—as compared to the incidental contamination note above, which may occur during manufacture and distribution while both unleaded and leaded aviation gasolines are being provided. This aspect of the unleaded aviation gasoline fuel blends described herein may be important to users and to fuel suppliers during any change-over period, or during flights to other countries, for example, as pilots may encounter fuel stations which either are selling unleaded aviation gasoline, or may be selling prior art leaded aviation gasoline. Consequently practice of the methods using an unleaded aviation gasoline having changeover lead contamination therein, as just described, is an important improvement in the art.

In summary, various novel unleaded aviation gasoline blends have been described, as well as methods for their formulation, preparation, manufacture, and methods for using the same in aircraft engine applications. Testing has revealed that it is possible to provide blends of unleaded aviation gasolines, by combining high quality unleaded base fuels, such as high quality aviation alkylate or commercial iso-octane, with one or more di-alkylated or tri-alkylated benzenes, in order to formulate an unleaded aviation gasoline that exhibits, in full scale high performance aviation piston engines, detonation performance at least equivalent (the FSEEMON) to that of a selected FBO Grade 100LL avgas having a selected MON. Those alkylated benzenes which provide octane enhancing properties to the unleaded aviation gasoline and which may be particularly useful in providing economic unleaded aviation gasoline fuel blends are, in an embodiment, those wherein the amount of commercially available di-alkylated benzenes, and particularly xylol mixtures including 1,3-dimethylbenzene, may be maximized in a novel high octane unleaded aviation gasoline blend.

Evaluation of the detonation performance properties of various unleaded aviation gasoline fuel blends as described herein may be carried out by methods known to those of skill in the art and to whom this specification is directed, using known methods. For example, attention is drawn to the various FAA reports first noted above, where, for example, the DOT/FAA/AR-TN07/5 report of March 2007, where description is made of the testing of detonation performance of various fuels. Attention is also drawn to ASTM Standard D-2700, entitled "Test Method for Detonation Characteristics of Motor and Aviation Fuels by the Motor Method," which is the test method indicated for use for determination of knock value, lean mixture octane number, under ASTM Standard D910. Also, attention is drawn to ASTM Standard ASTM D6424 -04a(2010), entitled "Standard Practice for Octane Rating Naturally Aspirated Spark Ignition Aircraft Engines" as that method may be applicable for a particular fuel application. Attention is also drawn to ASTM Standard D-909, entitled "Standard Test Method for Supercharge Rating of Spark-Ignition Aviation Gasoline" as that method may be applicable for certain tests required under the ASTM Standard D910 just referred to above. Attention is drawn to the necessity to appreciate the statistically variable nature of the detonation phenomena, and to account for that variability in properly conducting detonation testing.

Various methods are known for manufacture of various of the noted dialkylated benzenes and trialkylated benzenes. For example, the triakylated benzene 1,3,5-trimethylbenzene (mesitylene) has been the subject of various patents. Methods of manufacture have been discussed in the following: U.S. Pat. No. 5,087,781 entitled Method of Making Mesitylene, describes the use of a niobium catalyst for vapor phase reaction of acetone. U.S. Pat. No. 3,267,165, entitled Preparation of Mesitylene by Dehydrocondensation of Acetone, describes the reaction of acetone with sulfuric acid and polyphosphoric acid, and recovery of mesitylene by steam distillation. U.S. Pat. No. 2,917,561 entitled Production of Mesitylene, describes the use of a vapor phase reaction using a catalyst. Swift Enterprises, Inc, assignee of US Patent Application Publication No. 2008/0244961 A1, published on Oct. 9, 2008, reveals a biological derived material method for production of Mesitylene. And, with respect to the production of an alkylated benzene or a mixture of alkylated benzenes, one example of a process for the production of the same is disclosed in U.S. Pat. No. 6,297,417 B1, issued Oct. 2, 2001, and assigned to The Dow Chemical Company.

In the foregoing description, for purposes of explanation, numerous details have been set forth in order to provide a thorough understanding of the disclosed exemplary embodiments for the formulation of unleaded aviation gasoline blends. For descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in a method described herein may have been described as multiple discrete activities, in turn, in a manner that is most helpful in understanding the developments described herein. However, the order of description should not be construed as to imply that such activities are necessarily order dependent. In particular, certain mixing or blending operations may not necessarily need to be performed in the order of presentation. And, in different embodiments, one or more activities may be performed simultaneously, rather than sequentially. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

Further, it should be understood by those of skill in the art and to whom this specification is directed that the term "aircraft" has been used herein consistent with US Federal Aviation Administration regulations to mean a device that is used or intended to be used for flight in the air. Under the same regulations and as used herein, the term "rotorcraft" means a heavier-than-air aircraft that depends principally for its support in flight on the lift generated by one or more rotors. Similarly, under the same regulations and as used herein, the term "helicopter" means a rotorcraft that, for its horizontal motion, depends principally on its engine-driven rotors. Finally, under the same regulations and as used herein, an "aircraft engine" means an engine that is used or is intended to be used for propelling aircraft. Appurtenances and accessories, and air compressors such as turbochargers, are normally considered by those of skill in the art, and under applicable FAA regulations, as components of the aircraft engines with respect to which they are operably connected. Thus, the unleaded aviation gasoline fuel blends described and claimed herein should be considered as useful for such piston driven "aircraft engines".

Importantly, the aspects and embodiments described and claimed herein may be modified from those shown without materially departing from the novel teachings and advantages provided by the developments disclosed herein, and may be embodied in other specific forms without departing from the spirit or essential characteristics thereof. Therefore, the embodiments presented herein are to be considered in all respects as illustrative and not restrictive or limiting. As such, this disclosure is intended to cover the formulations and blends described herein and the legal equivalents thereof. Numerous modifications and variations are possible in light of the above teachings. Therefore, the protection afforded should be limited only by the claims set forth herein, and the legal equivalents thereof.

The invention claimed is:

1. A high octane unleaded aviation gasoline, the high octane unleaded aviation gasoline compatible for use in spark ignition aviation piston engines, comprising:

(a) at least one unleaded aviation gasoline base fuel having a selected motor octane number;

(b) one or more monoalkylated benzenes, wherein the one or more monoalkylated benzenes comprises toluene, and wherein the toluene comprises more than zero percent (0%), but no more than ten percent (10%) by weight of the high octane unleaded aviation gasoline;

(c) one or more dialkylated benzenes, the one or more dialkylated benzenes comprising one or more of meta-xylene, para-xylene, and ortho-xylene, wherein the para-xylene comprises no more than thirteen percent (13%) by weight of the high octane unleaded aviation gasoline, wherein the ortho-xylene comprises no more than eleven percent (11%) by weight of the high octane unleaded aviation gasoline, and wherein the meta-xylene and the para-xylene together comprise no more than forty five percent (45%) by weight of the unleaded aviation gasoline;

(d) one or more aromatic amines; the one or more aromatic amines comprising meta-toluidine, and wherein the meta-toluidine is present in a range from more than zero percent (0%) to about six percent (6.0%) by weight;

(e) wherein (1) the one or more aromatic amines, (2) the one or more monoalkylated benzenes, and (3) the one or more dialkylated benzenes, collectively comprise at least thirty seven percent (37%) by weight of the high octane unleaded aviation gasoline, but no more than fifty one percent (51%) by weight of the high octane unleaded aviation gasoline, and are provided in amounts which, when combined, are sufficient to provide detonation performance of the high octane unleaded aviation gasoline in a full scale aircraft engine to the equivalent, or better, than the detonation performance in the full scale aircraft engine of a selected Grade 100LL avgas; and (f) wherein the high octane unleaded aviation gasoline comprises from about one percent (1%) to about twenty percent (20%) of $C_4$ to $C_5$ paraffins by weight, and wherein the $C_4$ to $C_5$ paraffins comprise n-butane, or iso-butane, or a mixture thereof and wherein the $C_4$ to $C_5$ paraffins comprise from more than zero percent (0%) to five percent (5%), by weight of the high octane unleaded aviation gasoline.

2. A high octane unleaded aviation gasoline as set forth in claim 1, wherein the at least one unleaded aviation gasoline base fuel comprises aviation alkylate.

3. A high octane unleaded aviation gasoline as set forth in claim 1, wherein the at least one unleaded aviation gasoline base fuel comprises a commercial grade iso-octane.

4. A high octane unleaded aviation gasoline as set forth in claim 1, wherein the at least one unleaded aviation gasoline base fuel comprises iso-octane.

5. A high octane unleaded aviation gasoline as set forth in claim 1, wherein the at least one unleaded aviation gasoline base fuel consists essentially of iso-octane.

6. A high octane unleaded aviation gasoline as set forth in claim 2, or in claim 3, or in claim 4, or in claim 5, wherein the unleaded aviation gasoline base fuel has a selected motor octane number of 95 or higher.

7. A high octane unleaded aviation gasoline as set forth in claim 3, or in claim 4, or in claim 5, wherein the unleaded aviation gasoline base fuel has a selected motor octane number of 97 or higher.

8. A high octane unleaded aviation gasoline as set forth in claim 3, or in claim 4, or in claim 5, wherein the unleaded aviation gasoline base fuel has a selected motor octane number of 98 or higher.

9. A high octane unleaded aviation gasoline as set forth in claim 3, or in claim 4, or in claim 5, wherein the unleaded aviation gasoline base fuel has a selected motor octane number of 99 or higher.

10. A high octane unleaded aviation gasoline as set forth in claim 1, wherein the high octane unleaded aviation gasoline is comprised of from about twenty percent (20%) to about fifty percent (50%) by weight of iso-octane.

11. A high octane unleaded aviation gasoline as set forth in claim 8, wherein the high octane unleaded aviation gasoline is comprised of from about thirty percent (30%) to about forty five percent (45%) by weight of iso-octane.

12. A high octane unleaded aviation gasoline as set forth in claim 1, wherein the one or more monoalkylated benzenes comprises ethyl benzene, and wherein the ethyl benzene comprises no more than eight percent (8%) by weight of the high octane unleaded aviation gasoline.

13. A high octane unleaded aviation gasoline as set forth in claim 12, wherein the ethyl benzene comprises between about two percent (2%) and about five percent (5%), by weight, of the unleaded aviation gasoline.

14. The high octane unleaded aviation gasoline as set forth in claim 1, wherein the meta-toluidine is present in a range from more than zero percent (0%) to about four point five percent (4.5%) by weight.

15. The high octane unleaded aviation gasoline set forth in claim 1, wherein the meta-toluidine is present in a range from about one percent (1.0%) to about four point five percent (4.5%) by weight.

16. The high octane unleaded aviation gasoline set forth in claim 1, wherein the meta-toluidine is present in a range from about two point seven percent (2.7%) to about four point five percent (4.5%) by weight.

17. A high octane unleaded aviation gasoline as set forth in claim 1, wherein n-butane comprises between about two percent (2%) and about three percent (3%), by weight of the high octane unleaded aviation gasoline.

18. A high octane unleaded aviation gasoline as set forth in claim 1, wherein iso-butane comprises between more than zero percent (0%) to about one percent (1%) by weight of the high octane unleaded aviation gasoline.

19. A high octane unleaded aviation gasoline as set forth in claim 1, wherein the $C_4$ to $C_5$ paraffins comprise iso-pentane.

20. A high octane unleaded aviation gasoline as set forth in claim 19, wherein the iso-pentane is present at from about five percent (5%) to about ten percent (10%) by weight of the high octane unleaded aviation gasoline.

21. A high octane unleaded aviation gasoline as set forth in claim 1, wherein the high octane unleaded aviation gasoline has a knock value, as Motor Octane Number, of at least 99.6, when tested per the requirements as set forth in ASTM Standard D2700.

22. A high octane unleaded aviation gasoline as set forth in claim 1, or in claim 19, wherein the high octane unleaded aviation gasoline has a Performance Number of at least 130, when tested per the requirements as set forth in ASTM Standard D909.

23. A high octane unleaded aviation gasoline as set forth in claim 1, or in claim 21, wherein the high octane unleaded aviation gasoline has a Performance Number of 150 or more, when tested per the requirements as set forth in ASTM Standard D909.

24. A high octane unleaded aviation gasoline as set forth in claim 21, wherein the high octane unleaded aviation gasoline has a freezing point of minus fifty eight degrees centigrade (−58° C.), or less.

25. A high octane unleaded aviation gasoline as set forth in claim 1 or claim 21, wherein the high octane unleaded aviation gasoline has a vapor pressure at thirty eight degrees centigrade (38° C.) of not less than 38.0 kPa, and not more than 49.0 kPa.

26. A high octane unleaded aviation gasoline as set forth in claim 1, further comprising one or more trialkylated benzenes, and wherein the trialkylated benzenes are present in the high octane unleaded aviation gasoline in a range from more than zero percent (0%) by weight to forty five percent (45%) by weight.

27. A high octane unleaded aviation gasoline as set forth in claim 26, wherein the one or more trialkylated benzenes comprises 1,3,5-trimethylbenzene.

28. A high octane unleaded aviation gasoline as set forth in claim 1, wherein the one or more dialkylated benzenes are selected from the group consisting of meta-xylene, para-xylene, and ortho-xylene.

29. A high octane unleaded aviation gasoline as set forth in claim 1, wherein the high octane unleaded aviation gasoline is fully fungible with Grade 100LL aviation gasoline.

30. A high octane aviation gasoline as set forth in claim 1, wherein the high octane unleaded aviation gasoline comprises a functional drop-in substitute for Grade 100LL aviation gasoline.

31. A process for operating an aircraft engine, comprising:
providing an aircraft engine, wherein the aircraft engine was mechanically designed with pistons in cylinders for use by combustion of a leaded aviation gasoline having a 99.6 motor octane number (MON) or better while utilizing a spark ignition system; and
operating the aircraft engine while combusting the high octane unleaded aviation gasoline set forth in claim 1.

32. The process as set forth in claim 31, wherein the one or more aromatic amines consists essentially of m-toluidine.

33. The process as set forth in claim 31, wherein the meta-toluidine is present in a range from about one percent (1.0%) to about four point five percent (4.5%) by weight.

34. The process as set forth in claim 31, wherein the meta-toluidine is present in a range from about two percent (2%) to about four point five percent (4.5%) by weight.

35. The process as set forth in claim 31, wherein the meta-toluidine is present in a range from about two point seven percent (2.7%) to about four point five percent (4.5%) by weight.

36. The process as set forth in claim 31, wherein the high octane aviation gasoline comprises a functional drop-in substitute for Grade 100LL aviation gasoline.

37. A process for operating an aircraft engine, comprising:
providing an aircraft engine configured using pistons in cylinders for combustion of a fuel using a spark ignition system; and
operating the aircraft engine while combusting the high octane unleaded aviation gasoline set forth in claim 1.

38. The process as set forth in claim 37, wherein the one or more aromatic amines consists essentially of m-toluidine.

39. The process as set forth in claim 37, wherein the meta-toluidine is present in a range from about one percent (1.0%) to about four point five percent (4.5%) by weight.

40. The process as set forth in claim 37, wherein the meta-toluidine is present in a range from about two percent (2%) to about four point five percent (4.5%) by weight.

41. The process as set forth in claim 37, wherein the meta-toluidine is present in a range from about two point seven percent (2.7%) to about four point five percent (4.5%) by weight.

* * * * *